US010954462B2

(12) United States Patent
Tsou et al.

(10) Patent No.: US 10,954,462 B2
(45) Date of Patent: Mar. 23, 2021

(54) BIMODAL BOTTLEBRUSH POLY(ALPHA OLEFIN) SOLID LUBRICANTS

(71) Applicant: ExxonMobil Chemical Patents Inc., Baytown, TX (US)

(72) Inventors: Andy H. Tsou, Houston, TX (US); Carlos R. Lopez-Barron, Houston, TX (US); John R. Hagadorn, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 30 days.

(21) Appl. No.: 16/253,108

(22) Filed: Jan. 21, 2019

(65) Prior Publication Data

US 2019/0233755 A1 Aug. 1, 2019

Related U.S. Application Data

(60) Provisional application No. 62/623,383, filed on Jan. 29, 2018.

(51) Int. Cl.
*C10M 119/02* (2006.01)
*C10M 169/02* (2006.01)
(Continued)

(52) U.S. Cl.
CPC ..... *C10M 119/02* (2013.01); *C10M 101/00* (2013.01); *C10M 105/04* (2013.01);
(Continued)

(58) Field of Classification Search
CPC ..... C10M 119/02; C10M 169/02; C10M 101/00; C10M 105/04; C10M 2205/028; C10M 2203/024; C10M 2203/003; C10M 2205/0285; C10N 2220/021; C10N 2220/028; C10N 2250/10; C10N 2250/08; C10N 2230/68; C10N 2230/02
See application file for complete search history.

(56) References Cited

U.S. PATENT DOCUMENTS 9,102,773 B2 8/2015 Hagadorn et al. .... C08F 210/06
10,208,140 B2 2/2019 Hagadorn et al. ..... C08F 10/06
(Continued)

FOREIGN PATENT DOCUMENTS

WO WO-2017181274 A1 * 10/2017 ..... C08L 5/08

OTHER PUBLICATIONS

Lopez-Barron et al., "Microstructure of Crystallizable α-Olefin Molecular Bottlebrushes: Isotactic and Atactic Poly(1-octadecene)," Macromolecules, 2018, vol. 51, No. 3, pp. 872-883.

*Primary Examiner* — Taiwo Oladapo

(57) ABSTRACT

Bottlebrush poly(alpha olefin)s of high carbon number, greater than 12 such as poly(octadecene), are used as a thickener for a synthetic base oil grease lubricant that is based on oligomerized alpha olefin with carbon number from 7 to 12, such as oligo(decene). Dispersion aids are not required in the present lubricants because poly(octadecene) can be dissolved in oligo(decene). The lubricant is a solid grease formed by percolation/network of the poly(octadecene) crystals, at a sufficient concentration, after the crystallization of poly(octadecene), and water resistant having oxidation/high temperature stability.

13 Claims, 9 Drawing Sheets

(51) Int. Cl.

| | |
|---|---|
| ***C10M 101/00*** | (2006.01) |
| ***C10M 105/04*** | (2006.01) |
| *C10N 20/04* | (2006.01) |
| *C10N 20/00* | (2006.01) |
| *C10N 50/08* | (2006.01) |
| *C10N 50/10* | (2006.01) |

(52) U.S. Cl.
CPC .... *C10M 169/02* (2013.01); *C10M 2203/003* (2013.01); *C10M 2203/024* (2013.01); *C10M 2205/028* (2013.01); *C10N 2020/04* (2013.01); *C10N 2020/071* (2020.05); *C10N 2050/08* (2013.01); *C10N 2050/10* (2013.01)

(56) References Cited

U.S. PATENT DOCUMENTS

| | | | | |
|---|---|---|---|---|
| 2009/0247441 | A1 | 10/2009 | Baum | 508/552 |
| 2010/0087349 | A1* | 4/2010 | Lee | C10M 111/04 508/499 |
| 2014/0274849 | A1 | 9/2014 | Lee et al. | 508/591 |
| 2019/0099521 | A1* | 4/2019 | Banquy | C08F 265/06 |

* cited by examiner

BIMODAL BOTTLEBRUSH POLY(ALPHA OLEFIN) SOLID LUBRICANTS

STATEMENT OF RELATED APPLICATIONS

This application claims the benefit of and priority to U.S. Provisional Application No. 62/623,383, filed Jan. 29, 2018, which is incorporated herein by reference.

FIELD OF THE INVENTION

The present disclosure relates to the preparation of bottlebrush blends and more specifically, to bimodal poly(alpha olefin) ("PAO") blends having a sufficient concentration of high carbon number PAOs to provide grease lubricant that is water resistant and high temperature stable.

BACKGROUND OF THE INVENTION

Lubricating grease (also referred to as "grease lubricant") is a solid to semifluid product with dispersion of a thickening agent in the liquid lubricant product—base stock (oil), as defined by ADTM D 288. The grease lubricant typically comprises 70 to 95% base oil, 3 to 30% thickener, and up to 10% of additives. The base oil can be mineral oil or synthetic fluid. For extreme temperature ranges, from low to high, synthetic oils are preferred.

Common synthetic fluids are based on oligomers of octene, decene, or dodecene, or their mixtures. Thickeners can be simple metal soaps, complex metal soaps, and non-soaps. Soaps include calcium stearate, sodium stearate, lithium stearate, and their mixtures. Fatty acid derivatives other than stearates have been used, such as lithium 12-hydroxysterate. Non-soaps are powdered solids such as clays, bentonites, or silica aerogels. An inverse micelle is formed when soap thickeners are added into the base oil. A sufficient amount of soaps is necessary in a grease lubricant allowing these inverse micelles to percolate, or network, in order to phase transition of a liquid oil to a solid grease. Grease lubricants ("greases") are considered as pseudo-plastic fluids and, after sufficient shear forces are applied, greases can flow as liquids with viscosity values approaching that of the base oil. For a soap-emulsified-oil grease, this involves the breakdown of the inverse micelles by shear forces and the inverse micelle network, thus, allowing the base oil to flow as a liquid. The grease lubricants are needed for machines which infrequently require lubrication and/or solid lubricants to stay in position. Grease lubricants can also act as sealants to prevent ingress of water and other polar molecules, such as alcohols.

Issues associated with the soap-emulsified-oil grease lubricants are water resistance, oxidation, and high temperature stability since soaps can be dissolved in water and are easily oxidized and degraded at high temperatures. Even for the non-soap solid thickeners, soaps or dispersion aids are required in order to be suspended in oils without settlement. While these solids are oxidative and thermal resistant, the dispersants are not.

A need exists for a grease lubricant comprising synthetic base thickeners which do not require dispersion aids and are water resistant and stable at high temperatures.

SUMMARY

Novel bimodal blends are provided herein. The bimodal blend comprises a first PAO composition and a second PAO composition. The first PAO composition and the second PAO composition are produced by coordinative insertion polymerization. The concentration of the second PAO composition is between about 1 wt % and 40 wt % of the total weight of the bimodal blend. The concentration of the first PAO composition in the bimodal blend is between about 60 wt % and 99 wt % of the total weight of the bimodal blend. The first PAO composition has a number average molecular weight of less than 10,000 g/mol and a carbon number from 7 to 12. The second PAO composition has a number average molecular weight of 10,000 g/mol or more and carbon number greater than 12, preferably greater than 10,000 g/mol.

In any embodiment, the first PAO composition comprises oligomers. Further, the second PAO composition can comprise polymers. The first PAO composition can be produced with Group IV metallocone catalysts. The second PAO composition can be produced with a pyridyladiamido or a quinolyldiamido transition metal complex. More specifically, in any embodiment, the bimodal blend can comprise poly(alpha olefin)s of poly(1-heptene) and above and/or alpha olefins with a carbon number greater than 6.

In any embodiment, the bimodal blend comprises bottlebrushes. Preferably, the square root of the bottlebrush side chain is greater than the distance between side chains. Alternately, the square root of the bottlebrush polymer Mw is greater than the distance between side chains. In any embodiment, the bottlebrushes can have a fully extended backbone and bottlebrush conformation. Bottlebrush conformation is a branched polymer architecture where the side chain length is greater than the distance between side chains along the backbone. Typically, side chains derived from the alpha olefins used herein are five or more carbon atoms in length.

As described herein, in any embodiment, the bimodal blend is a solid lubricant having a yield stress less than 100 Pa. The bimodal blend is a liquid lubricant having a yield stress of greater than 100 Pa and a viscosity less than 100 Pa/s.

Further provided herein are lubricants comprising a base oil, and a thickener. The base oil can be selected from the group of mineral oil or synthetic fluid. In any embodiment, the synthetic fluid is an oligomer of octene, decene or dodecene. In any embodiment, the base oil is a PAO composition having a number average molecular weight of less than 10,000 g/mol. In any embodiment, the base oil comprises oligomers having a carbon number from 7 to 12.

The thickener comprises a PAO composition having a number average molecular weight of 10,000 g/mol or more (preferably greater than 10,000 g/mol) and carbon number greater than 12. The base oil and the thickener can be produced by coordinative insertion polymerization. The concentration of the base oil in the lubricant is between about 60 wt % and 99 wt % of the total weight of the bimodal blend. In any embodiment, the lubricant is a solid grease. In any embodiment, the lubricant does not contain dispersion aids. In any embodiment, the lubricant has a percolation of second PAO crystals.

Also provided herein are methods of making lubricants comprising the step of blending a first PAO composition and a second PAO composition. The first PAO composition has a number average molecular weight of less than 10,000 g/mol and a carbon number from 7 to 12 and the second PAO composition has a number average molecular weight of 10,000 g/mol or more (preferably greater than 10,000 g/mol) and carbon number greater than 12. Both the first and second PAO compositions are produced by coordinative insertion polymerization. The concentration of the first PAO composition in the lubricant is between about 60 wt % and 99 wt % of the total weight of the lubricant.

DETAILED DESCRIPTION

Figure 1:
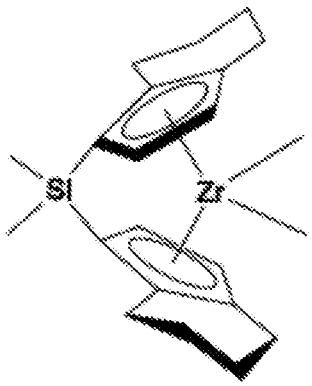
FIG. 1 depicts the catalyst used to synthesize the oligomeric decene compound in Example 1.

As provided herein, bottlebrush poly(alpha olefin)s ("PAO(s)") of high carbon number, greater than 12 such as poly(octadecene), are used as a thickener for a synthetic base oil grease lubricant ("lubricant") that is based on oligomerized alpha olefin with carbon number from 7 to 12, such as oligo(decene). As described herein, dispersion aids are not required in the present lubricants because poly(octadecene) can be dissolved in oligo(decene). As such, a solid grease lubricant is formed by percolation/network of the poly (octadecene) crystals, at a sufficient concentration, after the crystallization of poly(octadecene). The present poly(alpha olefin) lubricants are water resistant and provide oxidation/high temperature stability.

Further provided are bimodal poly(alpha olefin) (PAO) blends (referred to herein as bimodal blends or bottlebrush blends. The present bimodal blends comprise bottlebrush poly(alpha olefin) having high carbon number of sufficient concentration and are water resistant and high temperature stable as lubricant.

More specifically, poly(alpha olefin)s of poly(1-heptene) and above, or alpha olefins with carbon number greater than 6, are bottlebrushes. The square roots of the bottlebrush side chains are greater than the distances between side chains and therefore provide fully extended backbone and bottlebrush conformations. Alternately, the square root of the weight average molecular weight of the poly(alpha olefin)s of poly(1-heptene) and above is greater than the distance between side chains. In any embodiment, the poly(alpha olefin)s of poly(1-heptene) and above can have a fully extended backbone and bottlebrush conformation. Bottlebrush conformation is a branched polymer architecture where the side chain length is greater than the distance between side chains along the backbone. Typically, side chains in the poly(alpha olefin)s of poly(1-heptene) and above produced herein are five or more carbon atoms in length.

The present bimodal blends have bimodalities in both molecular weight and composition. The bimodal blends include a first PAO composition and a second PAO composition. The first PAO composition of the bimodal blend is a low molecular weight, Mn less than 10,000 g/mole and comprises a PAO composition with alpha olefin carbon number from 7 to 12. The second PAO composition of the bimodal blend has a high molecular weight, Mn of 10,000 g/mol or more (preferably greater than 10,000 g/mol) and comprises an alpha olefin carbon number equal or greater than 13. The first PAO composition is the majority phase of the bimodal blend with a concentration from 60 wt % to 99 wt % of the total bimodal blend. Each PAO composition is synthesized by coordinative insertion polymerization of linear alpha olefins. In any embodiment, weakly coordinated anion activated organometallic catalysts are used in solution to produce the PAO composition. More specifically, in any embodiment, Group IV metallocene catalysts with C2 symmetry can be used to produce the first PAO composition. In any embodiment, pyridyldiamide or quinolyldiamide transition metal catalysts or Group IV metallocene catalysts with Cs symmetry are used to produce the second PAO composition. The present bimodal blends can be solid lubricants having a yield stress preferably to be less than 100 Pa. At a yield stress greater than 100 Pa, the bimodal blends are liquid (where the solid phase moves into a liquid phase) having viscosity less than 100 Pa-s.

As used herein, the numbering scheme for the Periodic Table Groups is the notation as set out in Hawley's Condensed Chemical Dictionary (John Wiley & Sons, Inc. 1997). Therefore, a "Group 4 metal" is an element from Group 4 of the Periodic Table, e.g. Zr, Ti, and Hf.

The term "complex" refers to a catalyst precursor, precatalyst, catalyst, catalyst compound, transition metal compound, or transition metal complex. These words are used interchangeably. Activator and cocatalyst are also used interchangeably.

The term "catalyst system" refers to a complex/activator pair. When "catalyst system" is used to describe such a pair before activation, it means the inactivated catalyst complex (precatalyst) together with an activator and, optionally, a co-activator. When it is used to describe such a pair after activation, it means the activated complex and the activator or other charge-balancing moiety. The transition metal compound may be neutral as in a precatalyst, or a charged species with a counter ion as in an activated catalyst system.

The term "catalyst activity" refers to a measure of how many grams of polymer are produced using a polymerization catalyst.

As used herein, the term "olefin" refers to a linear, branched, or cyclic compound comprising carbon and hydrogen and having a hydrocarbon chain containing at least one carbon-to-carbon double bond in the structure thereof, where the carbon-to-carbon double bond does not constitute a part of an aromatic ring. The term "olefin" is intended to embrace all structural isomeric forms of olefins, unless it is specified to mean a single isomer or the context clearly indicates otherwise.

The term "alpha-olefin" refers to an olefin having a terminal carbon-to-carbon double bond in the structure thereof ($(R^1R^2)$—C═$CH_2$, where $R^1$ and $R^2$ can be independently hydrogen or any hydrocarbyl group. In any embodiment, $R^1$ is hydrogen, and $R^2$ is an alkyl group. A "linear alpha-olefin" is an alpha-olefin defined in this paragraph wherein $R^1$ is hydrogen, and $R^2$ is hydrogen or a linear alkyl group.

As used herein, a "polymer" has two or more of the same or different "mer" units. A "homopolymer" is a polymer having mer units that are the same. A "copolymer" is a polymer having two or more mer units that are different from each other. A "terpolymer" is a polymer having three mer units that are different from each other. "Different" in reference to mer units indicates that the mer units differ from each other by at least one atom or are different isomerically.

As used herein, when a polymer or copolymer is referred to as comprising an olefin, the olefin present in such polymer or copolymer is the polymerized form of the olefin. For example, when a copolymer is said to have a "propylene" content of 35 wt % to 55 wt %, it is understood that the mer unit in the copolymer is derived from propylene in the polymerization reaction and said derived units are present at 35 wt % to 55 wt %, based upon the weight of the copolymer. A copolymer can be terpolymers and the like.

As used herein, the term "polyalpha-olefin(s)" ("poly (alpha olefin)," or "PAO(s)") refers to oligomer(s) and/or polymer(s) of one or more alpha-olefin monomer(s). PAOs are oligomeric or polymeric molecules produced from the polymerization reactions of alpha-olefin monomer molecules in the presence of a catalyst system, and optionally hydrogenated to remove residual carbon-carbon double bonds therein. Thus, the PAO can be a dimer, a trimer, a tetramer, or any other oligomer or polymer comprising two or more structure units derived from one or more alpha-olefin monomer(s). The PAO molecule can be highly regio-regular, such that the bulk material exhibits an isotacticity, or a syndiotacticity when measured by $^{13}C$ NMR.

In any embodiment, the PAO is made by using a metallocene-based catalyst system sometimes referred to as a metallocene-PAO ("mPAO"). In any embodiment the PAO can made by using non-metallocene-based catalysts sometimes referred to as a conventional PAO ("cPAO"). Examples of non-metallocene-based catalysts include Lewis acids, supported chromium oxide, and the like.

The term "carbon backbone" refers to the longest straight carbon chain in the molecule of the compound or the group in question. "Branch" refers to any non-hydrogen group connected to the carbon backbone.

The term "pendant group" with respect to a PAO molecule refers to any group other than hydrogen attached to the carbon backbone other than those attached to the carbon atoms. at the very ends of the carbon backbone.

The term "Cn" group or compound refers to a group or a compound with total number carbon atoms "n." Thus, a "Cm—Cn" group or compound refers to a group or compound having total number of carbon atoms in a range from "m" to "n". For example, a C1-050 alkyl group refers to an alkyl compound having 1 to 50 carbon atoms.

As used herein, Me is methyl, Et is ethyl, Bu is butyl, t-Bu is tertiary butyl, Pr is propyl, iPr is isopropyl, Cy is cyclohexyl, and Bn is benzyl.

As used herein, "Mn" is number average molecular weight, "Mw" is weight average molecular weight, and "Mz" is z average molecular weight, wt % is wt %, and mol % is mole percent. Molecular weight distribution (MWD, or Mw/Mn) is defined to be Mw divided by Mn. Unless otherwise noted, all molecular weight units (e.g., Mw, Mn, Mz) are reported in g/mol.

The term "bulk polymerization" refers to a polymerization process in which the monomers and/or comonomers being polymerized are used as a solvent or diluent using little or no inert solvent as a solvent or diluent. A small faction of inert solvent might be used as a carrier for catalyst and scavenger. A bulk polymerization system contains less than 25 wt % of inert solvent or diluent, less than 10 wt %, less than 1 wt %, or 0 wt %.

The term "continuous process" refers to a system that operates without interruption or cessation. For example, a continuous process to produce a polymer would be one where the reactants are continually introduced into one or more reactors and polymer product is continually withdrawn.

As used herein, the term "solution polymerization" refers to a polymerization process in which the polymer produced is dissolved in a liquid polymerization medium at polymerization condition, such as an inert solvent or monomer(s) or their blends. A solution polymerization is typically homogeneous. A homogeneous polymerization is one where the polymer product is dissolved in the polymerization medium. Such systems may not be turbid as described in J. Vladimir Oliveira, C. Dariva, and J. C. Pinto, 29 Ind. Eng, Chem. Res., 4627 (2000).

The term "alkenyl" or "alkenyl group" interchangeably refers to a linear unsaturated hydrocarbyl group comprising a C═C bond therein.

The term "alkyl" or "alkyl group" interchangeably refers to a saturated hydrocarbyl group consisting of carbon and hydrogen atoms. An alkyl group can be linear, branched linear, cyclic, or substituted cyclic.

As used herein the term "aromatic" also refers to pseudo-aromatic heterocycles which are heterocyclic substituents that have similar properties and structures (nearly planar) to aromatic heterocyclic ligands, but are not by definition aromatic; likewise, the term aromatic also refers to substituted aromatics The term "aryl" or "aryl group" means a six carbon aromatic ring and the substituted variants thereof, including but not limited to, phenyl, 2-methyl-phenyl, xylyl, 4-bromo-xylyl. Likewise heteroaryl means an aryl group where a ring carbon atom (or two or three ring carbon atoms) has been replaced with a heteroatom, preferably N, O, or S. The term "aryl" or "aryl group" interchangeably refers to a hydrocarbyl group comprising an aromatic ring structure therein.

The term "cycloalkyl" or "cycloalkyl group" interchangeably refers to a saturated hydrocarbyl group wherein the carbon atoms form one or more ring structures and refers to cyclic hydrocarbyl group comprising a C═C bond in the ring.

As used herein, the terms, "cyclopentadiene" and "cyclopentadienyl" are abbreviated as Cp.

A "heterocyclic ring" is a ring having a heteroatom (non-carbon) in the ring structure as opposed to a heteroatom substituted ring where a hydrogen on a ring atom is replaced with a heteroatom. For example, tetrahydrofuran is a heterocyclic ring and 4-N,N-dimethylamino-phenyl is a heteroatom substituted ring.

Unless otherwise indicated, (e.g., the definition of "substituted hydrocarbyl", "substituted aromatic", etc.), the term "substituted" means that at least one hydrogen atom has been replaced with at least one non-hydrogen group, such as a hydrocarbyl group, a heteroatom, or a heteroatom containing group, such as halogen (such as Br, Cl, F or I) or at least one functional group such as —$NR^*_2$, —$OR^*$, —$SeR^*$, —$TeR^*$, —$PR^*_2$, —$AsR^*_2$, —$SbR^*_2$, —$SR^*$, —$BR^*_2$, —$SiR^*_3$, —$GeR^*_3$, —$SnR^*_3$, —$PbR^*_3$, where each R* is independently a hydrocarbyl or halocarbyl radical, and two or more R* may join together to form a substituted or unsubstituted completely saturated, partially unsaturated, or aromatic cyclic or polycyclic ring structure), or where at least one heteroatom has been inserted within a hydrocarbyl ring.

In a preferred embodiment, a "substituted" group such is a group having one or more functional moieties bound thereto such as F, Cl, Br, I, $C(O)R^*$, $C(O)NR^*_2$, $C(O)OR^*$, $NR^*_2$, $OR^*$, $PR^*_2$, $SR^*$, $BR^*_2$, $SiR^*_3$, and the like (where R* is independently a hydrogen or hydrocarbyl radical, and two or more R* may join together to form a substituted or unsubstituted saturated, partially unsaturated or aromatic cyclic or polycyclic ring structure).

The term "substituted hydrocarbyl" means a hydrocarbyl radical in which at least one hydrogen atom of the hydrocarbyl radical has been substituted with at least one heteroatom (such as halogen, e.g., Br, Cl, F or I) or heteroatom-containing group (such as a functional group, e.g., —$NR^*_2$, —$OR^*$, —$SeR^*$, —$TeR^*$, —$PR^*_2$, —$AsR^*_2$, —$SbR^*_2$, —$SR^*$, —$BR^*_2$, —$SiR^*_3$, —$GeR^*_3$, —$SnR^*_3$, —$PbR^*_3$, where each R* is independently a hydrocarbyl or halocarbyl radical, and two or more R* may join together to form a substituted or unsubstituted completely saturated, partially unsaturated, or aromatic cyclic or polycyclic ring structure), or where at least one heteroatom has been inserted within a hydrocarbyl ring.

The term "hydrocarbyl substituted phenyl" means a phenyl group having 1, 2, 3, 4 or 5 hydrogen groups replaced by a hydrocarbyl or substituted hydrocarbyl group. For example, the "hydrocarbyl substituted phenyl" group can be represented by the formula:

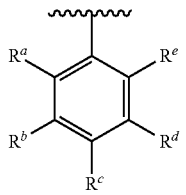

where each of $R^a$, $R^b$, $R^c$, $R^d$, and $R^e$ can be independently selected from hydrogen, $C_1$-$C_{40}$ hydrocarbyl or $C_1$-$C_{40}$ substituted hydrocarbyl, a heteroatom or a heteroatom-containing group (provided that at least one of $R^a$, $R^b$, $R^c$, $R^d$, and $R^e$ is not H), or two or more of $R^a$, $R^b$, $R^c$, $R^d$, and $R^e$ can be joined together to form a $C_4$-$C_{62}$ cyclic or polycyclic hydrocarbyl ring structure, or a combination thereof.

The term "substituted aromatic," means an aromatic group having 1 or more hydrogen groups replaced by a hydrocarbyl, substituted hydrocarbyl, heteroatom or heteroatom containing group.

The term "substituted phenyl," mean a phenyl group having 1 or more hydrogen groups replaced by a hydrocarbyl, substituted hydrocarbyl, heteroatom or heteroatom containing group.

The term "substituted aryl," mean an aryl group having 1 or more hydrogen groups replaced by a hydrocarbyl, substituted hydrocarbyl, heteroatom or heteroatom containing group.

The term "substituted cyclic," mean a cyclic group having 1 or more hydrogen groups replaced by a hydrocarbyl, substituted hydrocarbyl, heteroatom or heteroatom containing group.

The terms "hydrocarbyl radical," "hydrocarbyl," and "hydrocarbyl group" are used interchangeably throughout this document. Likewise, the terms "group," "radical," and "substituent" are also used interchangeably in this document. For purposes of this disclosure, "hydrocarbyl radical" is defined to be $C_1$-$C_{100}$ radicals, that may be linear, branched, or cyclic, and when cyclic, aromatic or non-aromatic. The term "hydrocarbyl group" or "hydrocarbyl" interchangeably refers to a group consisting of hydrogen and carbon atoms only. A hydrocarbyl group can be saturated or unsaturated, linear or branched linear, cyclic or acyclic, aromatic or non-aromatic.

Unless specified otherwise, the term "substantially all" with respect to PAO molecules means at least 90 mol % (such as at least 95 mol %, at least 98 mol %, at least 99 mol %, or even 100 mol %).

Unless specified otherwise, the term "substantially free of" with respect to a particular component means the concentration of that component in the relevant composition is no greater than 10 mol % (such as no greater than 5 mol %, no greater than 3 mol %, or no greater than 1 mol %), based on the total quantity of the relevant composition.

The terms "lubricant," "grease lubricant" and "grease" are used interchangeably herein and refers to a substance that can be introduced between two or more moving surfaces and lower the level of friction between two adjacent surfaces moving relative to each other. A lubricant "base stock" is a material used to formulate the lubricant by admixing it with other components. Non-limiting examples of base stocks suitable in lubricants include API Group I, Group II, Group III, Group IV, and Group V base stocks. Exemplary synthetic base stocks useful for making the lubricants described herein include, but are not limited to, fluids derived from a Fischer-Tropsch process or a Gas-to-Liquid ("GTL") process. Exemplary GTL processes are described in WO 2005/121280 A1, U.S. Pat. Nos. 7,344,631, 6,846,778, 7,241,375 and 7,053,254.

As used herein, kinematic viscosity values are determined according to ASTM D445. Kinematic viscosity at 100° C. is reported herein as KV100, and kinematic viscosity at 40° C. is reported herein as KV40. Units of all KV100 and KV40 values herein are cSt, unless otherwise specified. All viscosity index ("VI") values are as determined according to ASTM D2270.

All numerical values within the detailed description and the claims herein are modified by "about" or "approximately" the indicated value, and taking into account experimental error and variations.

As used herein, all percentages of pendant groups, terminal carbon chains, and side chain groups are by mole, unless specified otherwise. Percent by mole is expressed as "mol %," and percent by weight is expressed as "wt %."

The number average molecular weight (Mn) of the polymer is given by the equation $\Sigma n_i M_i / \Sigma n_i$, where "M" is the molecular weight of each polymer "i". The weight average molecular weight (Mw), z-average molecular weight (Mz), and Mz+1 value are given by the equation $\Sigma n_i M^{n+1} / \Sigma n_i M_i^n$, where for Mw, n=1, for Mz, n=$_2$, and for Mz+1, n=3, where $n_i$ in the foregoing equations is the number fraction of molecules of molecular weight $M_i$. Reported and claimed values for Mn are ±100 g/mole, for Mw are ±500 g/mole, and for Mz are ±10,000 g/mole. The expression "Mw/Mn" is the ratio of the weight average molecular weight (Mw) to the number average molecular weight (Mn).

As provided herein, molecular weight data is in the unit of $g \cdot mol^{-1}$. Molecular weight of oligomer or polymer compositions (including hydrogenated PAOs and unsaturated PAOs) and distribution thereof were measured by using gel permeation chromatography ("GPC") equipped with a multiple-channel band filter-based infrared detector ensemble IR5 ("GPC-IR") with band region covering from 2700-3000 $cm^{-1}$ (all saturated C—H stretching vibration). Reagent grade 1,2,4-trichlorobenzene ("TCB") (from Sigma-Aldrich) of 300 ppm antioxidant BHT can be used as the mobile phase at a nominal flow rate of 1.0 mL/min and a nominal injection volume 200 μL. These systems include transfer lines, columns, and detectors is contained in an oven maintained at 145° C. A given amount of sample is weighed and sealed in a standard vial with 10 μL flow marker (heptane) added thereto. After loading the vial in the autosampler, the oligomer or polymer is automatically dissolved in the instrument with 8 mL added TCB solvent at 160° C. with continuous shaking. The sample solution concentration is typically from 0.2 to 2.0 mg/ml, with lower concentrations used for higher molecular weight samples. The concentration, c, at each point in the chromatogram is calculated from the baseline-subtracted IRS broadband signal, I, using the equation: $c=\alpha I$, where $\alpha$ is the mass constant determined with polyethylene or polypropylene standards. The mass recovery is calculated from the ratio of the integrated area of the concentration chromatography over elution volume and the injection mass which is equal to the pre-determined concentration multiplied by injection loop volume. The molecular weights are determined by combining universal calibration relationship with the Mark-Houwink equation in which the M-H parameters $\alpha$/K are 0.695/0.00012 for polydecene homo and co-polymer and are 0.732/0.000043 for polyoctadecene homo and co-polymer. $\alpha$ and K for other materials are calculated using the universal calibration relationship as described in the published literature (Sun, T. et al. *Macromolecules* 2001, 34, 6812).

Number average molecular weight ("Mn") and weight average molecular weight ("Mw") of the oligomer or the polymer are obtained from the above process.

NMR spectroscopy provides key structural information about the synthesized polymers. Proton NMR (1H-NMR) analysis of the unsaturated PAO material gives a quantitative breakdown of the olefinic structure types. Carbon-13 NMR ("$^{13}$C-NMR") is used to determine tacticity of the PAOs of the present disclosure. Carbon-13 NMR can be used to determine the percentages of the triads, denoted (m, m)-triads (i.e., meso, meso), (m, r)-triads (i.e., meso, racemic), and (r,r)-triads (i.e., racemic, racemic), respectively. The concentrations of these triads define whether the polymer is isotactic, atactic or syndiotactic.

In the present disclosure, the percentage of the (m, m)-triads in mol % is recorded as the isotacticity of the PAO material. Spectra for a PAO sample are acquired in the following manner Approximately 100-1000 mg of the PAO sample is dissolved in 2-3 mL of chloroform-d for $^{13}$C-NMR analysis. The samples are run with a 60 second delay and 90° pulse with at least 512 transients. The tacticity was calculated using the peak around 35 ppm ($CH_2$ peak next to the branch point). Analysis of the spectra is performed according to the paper by Kim, I; Zhou, J.-M.; and Chung, H. 38 J. Poly. Sci.: Part A: Poly. Chem. 1687-1697 (2000). The calculation of tacticity is mm·100/(mm+mr+rr) for the molar percentages of (m,m)-triads, mr·100/(mm+mr+rr) for the molar percentages of (m,r)-triads, and rr·100/(mm+mr+rr) for the molar percentages of (r,r)-triads. The (m,m)-triads correspond to 35.5-34.55 ppm, the (m,r)-triads to 34.55-34.1 ppm, and the (r,r)-triads to 34.1-33.2 ppm.

The specification describes transition metal complexes. The term complex is used to describe molecules in which an ancillary ligand is coordinated to a central transition metal atom. The ligand is bulky and stably bonded to the transition metal so as to maintain its influence during use of the catalyst in polymerization. The ligand may be coordinated to the transition metal by covalent bond and/or electron donation coordination or intermediate bonds. Subsequently, the transition metal complexes are generally subjected to activation to perform their polymerization or oligomerization function using an activator which is believed to create a cation as a result of the removal of an anionic group, often referred to as a leaving group, from the transition metal. This process is referred to herein as coordinative insertion polymerization or coordination polymerization.

Pyridyldiamido Transition Metal Complexes

The pyridyldiamido transition metal complex has the general formula (I):

(I)

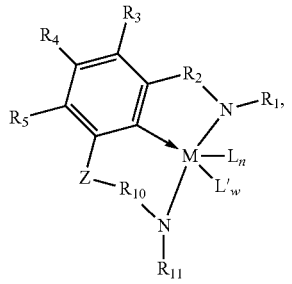

M is a Group 3, 4, 5, 6, 7, 8, 9, 10, 11, or 12 metal, a group 4 metal, or a group of Ti, Zr, or Hf;

Z is $—(R_{14})_pC—C(R_{15})_q—$ and where $R_{14}$ and $R_{15}$ are independently selected from the group consisting of hydrogen, alkyls, hydrocarbyls, and substituted hydrocarbyls, and wherein adjacent $R_{14}$ and $R_{15}$ groups may be joined to form an aromatic or saturated, substituted or unsubstituted hydrocarbyl ring, where the ring has 5, 6, 7, or 8 ring carbon atoms and where substitutions on the ring can join to form additional rings;

p is 1 or 2, and q is 1 or 2;

$R_1$ and $R_{11}$ are independently selected from the group consisting of hydrocarbyls, substituted hydrocarbyls, and silyl groups, alkyl, aryl, and heteroaryl;

$R_2$ and $R_{10}$ are each, independently, $-E(R_{12})(R_{13})—$ with E being carbon, silicon, or germanium, and each $R_{12}$ and $R_{13}$ being independently selected from the group consisting of hydrogen, hydrocarbyl, and substituted hydrocarbyl, alkoxy, silyl, amino, aryloxy, halogen, phosphino, alkyl, aryl, and heteroaryl. $R_{12}$ and $R_{13}$ may be joined to each other or to $R_{14}$ or $R_{15}$ to form a saturated, substituted or unsubstituted hydrocarbyl ring, where the ring has 4, 5, 6, or 7 ring carbon atoms and where substitutions on the ring can join to form additional rings, or $R_{12}$ and $R_{13}$ may be joined to form a saturated heterocyclic ring, or a saturated substituted heterocyclic ring where substitutions on the ring can join to form additional rings;

$R_3$, $R_4$, and $R_5$ are independently selected from the group consisting of hydrogen, alkyl, alkoxy, aryloxy, aryl, hydrocarbyls, substituted hydrocarbyls, halogen, amino, and silyl, wherein adjacent R groups ($R_3$ & $R_4$, and/or $R_4$ & $R_5$) may be joined to form a substituted or unsubstituted hydrocarbyl or heterocyclic ring, where the ring has 5, 6, 7, or 8 ring atoms and where substitutions on the ring can join to form additional rings;

L is an anionic leaving group, where the L groups may be the same or different and any two L groups may be linked to form a dianionic leaving group;

n is 0, 1, 2, 3, or 4;

L' is neutral Lewis base; and w is 0, 1, 2, 3 or 4.

Each of the R groups can contain 30 carbon atoms, no more than 30 carbon atoms, and especially from 2 to 20 carbon atoms.

The group represented by E is carbon, and $R_1$ and $R_{11}$ are independently selected from phenyl groups that are variously substituted with between zero to five substituents that include F, Cl, Br, I, $CF_3$, $NO_2$, alkoxy, dialkylamino, hydrocarbyl, and substituted hydrocarbyls, groups with from one to ten carbons.

The group represented by L is selected from halide, alkyl, aryl, alkoxy, amido, hydrido, phenoxy, hydroxy, silyl, allyl, alkenyl, and alkynyl; and the group represented by L' is selected from ethers, thio-ethers, amines, nitriles, imines, pyridines, and phosphines.

In any embodiment, Z is defined as an aryl so that the complex corresponds to formula (II):

(II)

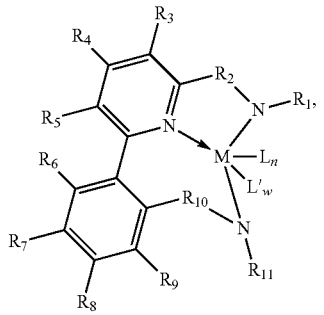

wherein:

$R_6$, $R_7$, $R_8$, and $R_9$ are independently selected from the group consisting of hydrogen, hydrocarbyls, substituted hydrocarbyls, alkoxy, halogen, amino, and silyl, and the pairs of positions, and wherein adjacent R groups ($R_6$, $R_7$, and/or $R_7$ and $R_8$, and/or $R_8$ and $R_9$, and/or $R_9$ and $R_{10}$) may be joined to form a saturated, substituted or unsubstituted hydrocarbyl or heterocyclic ring, where the ring has 5, 6, 7, or 8 ring carbon atoms and where substitutions on the ring can join to form additional rings; and M, L, L', w, n, $R_1$, $R_2$, $R_3$, $R_4$, $R_5$, $R_{10}$ and $R_{11}$ are as defined above.

In any embodiment, $R_1$ and $R_{11}$ may be independently selected from phenyl groups that are variously substituted with between zero to five substituents that include F, Cl, Br, I, $CF_3$, $NO_2$, alkoxy, dialkylamino, aryl, and alkyl groups with between one to ten carbons.

The complexes can be of the formula (III):

(III)

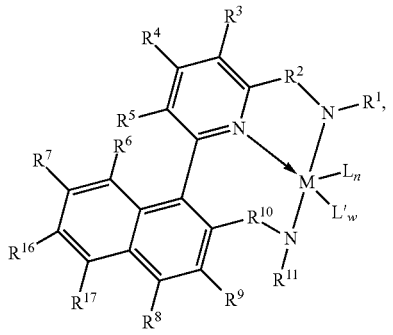

wherein:

$R^6$, $R^7$, $R^8$, $R^9$, $R^{16}$, and $R^{17}$ are independently selected from the group consisting of hydrogen, hydrocarbyls, substituted hydrocarbyls, alkoxy, halogen, amino, and silyl, and wherein adjacent R groups ($R^6$ & $R^7$, and/or $R^7$ & $R^{16}$, and/or $R^{16}$ & $R^{17}$, and/or $R^8$ & $R^9$) may be joined to form a saturated, substituted or unsubstituted hydrocarbyl or heterocyclic ring, where the ring has 5, 6, 7, or 8 ring carbon atoms and where substitutions on the ring can join to form additional rings; and M, L, L', w, n, $R^1$, $R^2$, $R^3$, $R^4$, $R^5$, $R^{10}$ and $R^{11}$ as defined above.

These complexes may be used in combination with appropriate activators for olefin polymerization such as ethylene-based polymers or propylene-based polymers, including ethylene-hexene polymerization.

Further, $R_1$ to $R_{13}$ can contain up to 30 carbon atoms, no more than 30 carbon atoms, or more particularly from 2 to 20 carbon atoms. $R_1$ and $R_{11}$ substituted on the nitrogen atom can be selected from aryl group containing from 6 to 30 carbon atoms, especially phenyl groups. $R_1$ and $R_{11}$ can be chosen from aryl or alkyl groups and $R_{12}$ through $R_{15}$ can be independently chosen from hydrogen, alkyl, and aryl groups, such as phenyl. The phenyl groups can be alkyl substituted. The alkyl substituents may be straight chain alkyls but include branched alkyls.

Moreover, each $R_1$ and $R_{11}$ can be a substituted phenyl group with either one or both of the carbons adjacent to the carbon joined to the amido nitrogen being substituted with a group containing between one to ten carbons. Examples include $R_1$ and $R_{11}$ chosen from the group including 2-methylphenyl, 2-isopropylphenyl, 2-ethylphenyl, 2,6-dimethylphenyl, mesityl, 2,6-diethylphenyl, and 2,6-diisopropylphenyl.

$R_2$ can be selected from moieties where E is carbon, especially a moiety —$C(R_{12})(R_{13})$— where $R_{12}$ is hydrogen and $R_{13}$ is an aryl group or a benzyl group (a phenyl ring linked through an alkylene moiety such as methylene to the C atom). The phenyl group can be substituted as described above. $R_3$ to $R_9$ are hydrogen or alkyl from 1 to 4 carbon atoms. $R_3$ to $R_9$ can be alkyl substituents.

The pyridyldiamido metal complex (I) is coordinated to the metal center as a tridentate ligand through two amido donors and one pyridyl donor. The metal center M is a transition metal from Groups 3 to 12. While in its use as a catalyst, M can be in the four valent state and it is possible to create compounds in which M has a reduced valency state and regains its formal valency state upon preparation of the catalysts system by contacting with an activator. In addition to the pyridyldiamido ligand, the metal M is also coordinated to n number of anionic ligands, with n being from 1 to 4. The anionic donors are typically halide or alkyl, but a wide range of other anionic groups are possible including some that are covalently linked together to form molecules that could be considered dianionic, such as oxalate. For certain complexes it is likely that up to three neutral Lewis bases (L'), typically ethers, could also be coordinated to the metal center. In any embodiment, w is 0, 1, 2 or 3.

An exemplary synthesis of the pyridyldiamido complexes is reaction of the neutral pyridyldiamine ligand precursors with a metalloamide, including $Zr(NMe_2)_4$, $Zr(NEt_2)_4$, $Hf(NMe_2)_4$, and $Hf(NEt_2)_4$. Another synthesis of the pyridyldiamido complexes is the reaction of the neutral pyridyldiamine ligand precursors with an organolithium reagent to form the dilithio pyridyldiamido derivative followed by reaction of this species with either a transition metal salt, including $ZrCl_4$, $HfCl_4$, $ZrCl_4$(1,2-dimethoxyethane), $HfCl_4$(1,2-dimethoxyethane), $ZrCl_4$(tetrahydrofuran)$_2$, $HfCl_4$(tetrahydrofuran)$_2$, $ZrBn_2Cl_2(OEt_2)$, $HfBn_2Cl_2(OEt_2)$. Another synthesis of the pyridyldiamido complexes is reaction of the neutral pyridyldiamine ligand precursors with an organometallic reactant, including $ZrBn_4$, $ZrBn_2Cl_2(OEt_2)$, $Zr(CH_2SiMe_3)_4$, $Zr(CH_2CMe_3)_4$, $HfBn_4$, $HfBn_2Cl_2(OEt_2)$, $Hf(CH_2SiMe_3)_4$, $Hf(CH_2CMe_3)_4$.

Quinolinyldiamido Transition Metal Complexes

Quinolinyldiamido transition metal complexes where a three-atom linker is used between the quinoline and the nitrogen donor in the 2-position of the quinoline ring are also useful to produce the present bimodal PAO blends. The three-atom linker is believed to yield a metal complex with a seven-membered chelate ring that is not coplanar with the other five-membered chelate ring. The resulting complex is thought to be effectively chiral ($C_1$ symmetry), even when there are no permanent stereocenters present. This is a desirable catalyst feature, for example, for the production of isotactic polyolefins.

Quinolinyldiamido transition metal complexes are represented by Formula (I), Formula (II), and Formula (III) as follows:

(I)

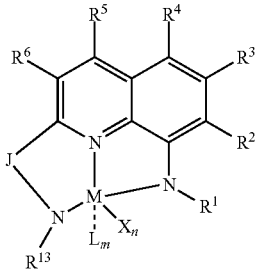

(II)

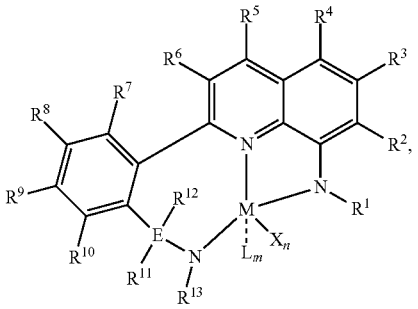

-continued (III)

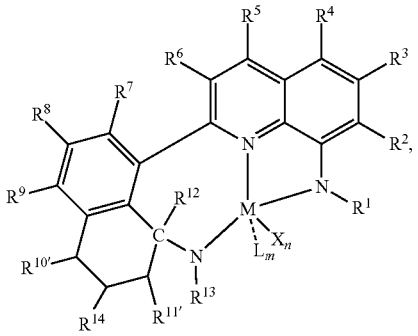

wherein M is a Group 3, 4, 5, 6, 7, 8, 9, 10, 11, or 12 metal;

J is a group comprising a three-atom-length bridge between the quinoline and the amido nitrogen, and preferably a group containing up to 50 non-hydrogen atoms;

E is carbon, silicon, or germanium;

X is an anionic leaving group, (such as a hydrocarbyl group or a halogen);

L is a neutral Lewis base;

$R^1$ and $R^{13}$ are independently selected from the group consisting of hydrocarbyls, substituted hydrocarbyls, and silyl groups;

$R^2$, $R^3$, $R^4$, $R^5$, $R^6$, $R^7$, $R^8$, $R^9$, $R^{10'}$, $R^{11}$, $R^{11'}$, $R^{12}$, and $R^{14}$ are independently hydrogen, hydrocarbyl, alkoxy, silyl, amino, aryloxy, substituted hydrocarbyl, halogen, or phosphino;

n is 1 or 2; and m is 0, 1, or 2, wherein n+m is not greater than 4;

any two R groups (e.g., $R^1$ & $R^2$, $R^2$ & $R^3$, $R^{10}$ and $R^{11}$, etc.) may be joined to form a substituted hydrocarbyl, unsubstituted hydrocarbyl, substituted heterocyclic, or unsubstituted heterocyclic, saturated or unsaturated ring, where the ring has 5, 6, 7, or 8 ring atoms and where substitutions on the ring can join to form additional rings;

any two X groups may be joined together to form a dianionic group;

any two L groups may be joined together to form a bidentate Lewis base; and any X group may be joined to an L group to form a monoanionic bidentate group.

In any embodiment M is a Group 4 metal, such as zirconium or hafnium.

In any embodiment, J is an aromatic substituted or unsubstituted hydrocarbyl having from 3 to 30 non-hydrogen atoms, where J is represented by the formula:

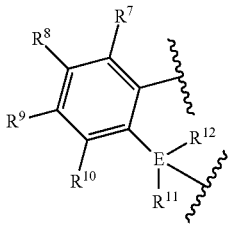

, and

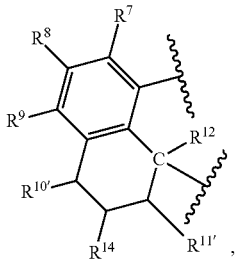

, where $R^7$, $R^8$, $R^9$, $R^{10}$, $R^{10'}$, $R^{11}$, $R^{11'}$, $R^{12}$, $R^{14}$ and E are as defined above, and any two R groups (e.g., $R^7$ & $R^8$, $R^8$ & $R^9$, $R^9$ & $R^{10}$, $R^{10}$ & $R^{11}$, etc.) may be joined to form a substituted or unsubstituted hydrocarbyl or heterocyclic ring, where the ring has 5, 6, 7, or 8 ring atoms (preferably 5 or 6 atoms), and said ring may be saturated or unsaturated (such as partially unsaturated or aromatic), J is an arylalkyl (such as arylmethyl, etc.) or dihydro-1H-indenyl, or tetrahydronaphthalenyl group.

In any embodiment, J is selected from the following structures:

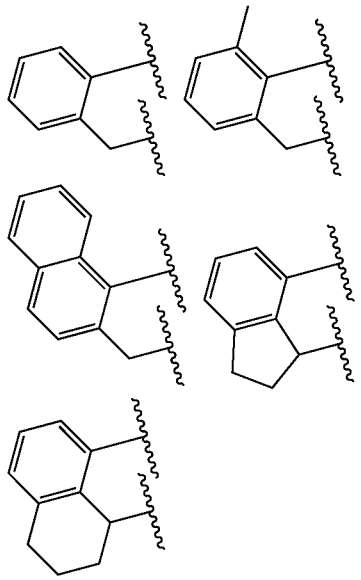

where ∿ indicates connection to the complex.

In any embodiment, E is carbon.

In any embodiment, X is alkyl (such as alkyl groups having 1 to 10 carbons, such as methyl, ethyl, propyl, butyl, pentyl, hexyl, heptyl, octyl, nonyl, decyl, and isomers thereof), aryl, hydride, alkylsilane, fluoride, chloride, bromide, iodide, triflate, carboxylate, amido (such as $NMe_2$), or alkylsulfonate.

In any embodiment, L is an ether, amine or thioether.

In any embodiment, $R^7$ and $R^8$ are joined to form a six-membered aromatic ring with the joined $R^7R^8$ group being —CH═CHCH═CH—.

In any embodiment, $R^{10}$ and $R^{11}$ are joined to form a five-membered ring with the joined $R^{10}R^{11}$ group being —$CH_2CH_2$—.

In any embodiment, $R^{10}$ and $R^{11}$ are joined to form a six-membered ring with the joined $R^{10}R^{11}$ group being —$CH_2CH_2CH_2$—.

In any embodiment, $R^1$ and $R^{13}$ may be independently selected from phenyl groups that are variously substituted with between zero to five substituents that include F, Cl, Br, I, $CF_3$, $NO_2$, alkoxy, dialkylamino, aryl, and alkyl groups having 1 to 10 carbons, such as methyl, ethyl, propyl, butyl, pentyl, hexyl, heptyl, octyl, nonyl, decyl, and isomers thereof.

In any embodiment, the quinolinyldiamido transition metal complex is represented by the Formula II where: M is a Group 4 metal (such as hafnium); E is selected from carbon, silicon, or germanium; X is an alkyl, aryl, hydride, alkylsilane, fluoride, chloride, bromide, iodide, triflate, carboxylate, amido, alkoxo, or alkylsulfonate; L is an ether, amine, or thioether; $R^1$ and $R^{13}$ are independently selected from the group consisting of hydrocarbyls, substituted hydrocarbyls, aryls, and silyl groups; $R^2$, $R^3$, $R^4$, $R^5$, $R^6$, $R^7$, $R^8$, $R^9$, $R^{10}$, $R^{11}$, and $R^{12}$ are independently hydrogen, hydrocarbyl, alkoxy, silyl, amino, aryloxy, substituted hydrocarbyls, halogen, and phosphino; n is 1 or 2; m is 0, 1, or 2; n+m is from 1 to 4; and two X groups may be joined together to form a dianionic group; two L groups may be joined together to form a bidentate Lewis base; an X group may be joined to an L group to form a monoanionic bidentate group; $R^7$ and $R^8$ may be joined to form a ring (such as an aromatic ring, a six-membered aromatic ring with the joined $R^7R^8$ group being —CH═CHCH═CH—); and $R^{10}$ and $R^{11}$ may be joined to form a ring (such as a five-membered ring with the joined $R^{10}R^{11}$ group being —$CH_2CH_2$—, a six-membered ring with the joined $R^{10}R^{11}$ group being —$CH_2CH_2CH_2$—).

In any embodiment of Formula I, II, and III, $R^4$, $R^5$, and $R^6$ are independently selected from the group consisting of hydrogen, hydrocarbyls, substituted hydrocarbyls, alkoxy, aryloxy, halogen, amino, and silyl, and wherein adjacent R groups ($R^4$ and $R^5$ and/or $R^5$ and $R^6$) may be joined to form a substituted hydrocarbyl, unsubstituted hydrocarbyl, unsubstituted heterocyclic ring or substituted heterocyclic ring, where the ring has 5, 6, 7, or 8 ring atoms and where substitutions on the ring can join to form additional rings.

In any embodiment of Formula I, II, and III, $R^7$, $R^8$, $R^9$, and $R^{10}$ are independently selected from the group consisting of hydrogen, hydrocarbyls, substituted hydrocarbyls, alkoxy, halogen, amino, and silyl, and wherein adjacent R groups ($R^7$ and $R^8$ and/or $R^9$ and) $R^{10}$) may be joined to form a saturated, substituted hydrocarbyl, unsubstituted hydrocarbyl, unsubstituted heterocyclic ring or substituted heterocyclic ring, where the ring has 5, 6, 7, or 8 ring carbon atoms and where substitutions on the ring can join to form additional rings.

In any embodiment of Formula I, II, and III, $R^2$ and $R^3$ are each, independently, selected from the group consisting of hydrogen, hydrocarbyls, and substituted hydrocarbyls, alkoxy, silyl, amino, aryloxy, halogen, and phosphino, $R^2$ and $R^3$ may be joined to form a saturated, substituted or unsubstituted hydrocarbyl ring, where the ring has 4, 5, 6, or 7 ring carbon atoms and where substitutions on the ring can join to form additional rings, or $R^2$ and $R^3$ may be joined to form a saturated heterocyclic ring, or a saturated substituted heterocyclic ring where substitutions on the ring can join to form additional rings.

In any embodiment of Formula I, II, and III, $R^{11}$ and $R^{12}$ are each, independently, selected from the group consisting of hydrogen, hydrocarbyls, and substituted hydrocarbyls, alkoxy, silyl, amino, aryloxy, halogen, and phosphino, $R^{11}$ and $R^{12}$ may be joined to form a saturated, substituted or unsubstituted hydrocarbyl ring, where the ring has 4, 5, 6, or 7 ring carbon atoms and where substitutions on the ring can join to form additional rings, or $R^{11}$ and $R^{12}$ may be joined to form a saturated heterocyclic ring, or a saturated substituted heterocyclic ring where substitutions on the ring can join to form additional rings, or $R^{11}$ and $R^{10}$ may be joined to form a saturated heterocyclic ring, or a saturated substituted heterocyclic ring where substitutions on the ring can join to form additional rings.

In any embodiment, Formula I, II, or III, $R^1$ and $R^{13}$ may be independently selected from phenyl groups that are variously substituted with between zero to five substituents that include F, Cl, Br, I, $CF_3$, $NO_2$, alkoxy, dialkylamino, aryl, and alkyl groups having 1 to 10 carbons, such as methyl, ethyl, propyl, butyl, pentyl, hexyl, heptyl, octyl, nonyl, decyl, and isomers thereof.

In any embodiment, Formula II, $R^{12}$-E-$R^{11}$ groups include $CH_2$, $CMe_2$, $SiMe_2$, $SiEt_2$, $SiPr_2$, $SiBu_2$, $SiPh_2$, $Si(aryl)_2$, $Si(alkyl)_2$, CH(aryl), CH(Ph), CH(alkyl), and CH(2-isopropylphenyl), where alkyl is a $C_1$ to $C_{40}$ alkyl group (such as $C_1$ to $C_{20}$ alkyl, one or more of methyl, ethyl, propyl, butyl, pentyl, hexyl, heptyl, octyl, nonyl, decyl, undecyl, dodecyl, and isomers thereof), aryl is a $C_5$ to $C_{40}$ aryl group (such as $C_6$ to $C_{20}$ aryl group, phenyl or substituted phenyl, 2-isopropylphenyl, or 2-tertbutylphenyl).

In any embodiment, Formula I, $R^{11}$, $R^{12}$, $R^9$, $R^{14}$, and $R^{10}$ are independently selected from the group consisting of hydrogen, hydrocarbyls, substituted hydrocarbyls, alkoxy, halogen, amino, and silyl, and wherein adjacent R groups ($R^{10}$ and $R^{14}$, and/or $R^{11}$ and $R^{14}$, and/or $R^9$ and $R^{10}$ may be joined to form a saturated, substituted hydrocarbyl, unsubstituted hydrocarbyl, unsubstituted heterocyclic ring or substituted heterocyclic ring, where the ring has 5, 6, 7, or 8 ring carbon atoms and where substitutions on the ring can join to form additional rings. The R groups above (i.e., any of $R^2$ to $R^{14}$) and other R groups mentioned hereafter, contain from 1 to 30, such as 2 to 20 carbon atoms, especially from 6 to 20 carbon atoms.

The R groups above (i.e., any of $R^2$ to $R^{14}$) and other R groups mentioned hereafter, are independently selected from the group consisting of hydrogen, methyl, ethyl, phenyl, isopropyl, isobutyl, trimethylsilyl, and —$CH_2$—$Si(Me)_3$.

In any embodiment, the quinolinyldiamide complex is linked to one or more additional transition metal complex, such as a quinolinyldiamide complex or a metallocene, through an R group in such a fashion as to make a bimetallic, trimetallic, or multimetallic complex that may be used as a catalyst component for olefin polymerization. The linker R-group in such a complex can contain 1 to 30 carbon atoms.

In any embodiment, M is Ti, Zr, or Hf, and E is carbon, with Zr or Hf based complexes being especially useful.

In any embodiment, E is carbon and $R^{12}$ and $R^{11}$ are independently selected from phenyl groups that are substituted with 0, 1, 2, 3, 4, or 5 substituents selected from the group consisting of F, Cl, Br, I, $CF_3$, $NO_2$, alkoxy, dialkylamino, hydrocarbyl, and substituted hydrocarbyl groups with from one to ten carbons.

In any embodiment, Formula II or Formula III, $R^{11}$ and $R^{12}$ are independently selected from hydrogen, methyl, ethyl, phenyl, isopropyl, isobutyl, —$CH_2$—$Si(Me)_3$, and trimethylsilyl.

In any embodiment of Formula II or Formula III, $R^7$, $R^8$, $R^9$, and $R^{10}$ are independently selected from hydrogen, methyl, ethyl, propyl, isopropyl, phenyl, cyclohexyl, fluoro, chloro, methoxy, ethoxy, phenoxy, —$CH_2$—$Si(Me)_3$, and trimethylsilyl.

In any embodiment, Formula I, Formula II, or Formula III, $R^2$, $R^3$, $R^4$, $R^5$, and $R^6$ are independently selected from the group consisting of hydrogen, hydrocarbyls, alkoxy, silyl, amino, substituted hydrocarbyls, and halogen and each L is independently selected from $Et_2O$, MeOtBu, $Et_3N$, $PhNMe_2$, $MePh_2N$, tetrahydrofuran, and dimethylsulfide.

In any embodiment, Formula III, $R^{10}$, $R^{11}$ and $R^{14}$ are independently selected from hydrogen, methyl, ethyl, phenyl, isopropyl, isobutyl, —$CH_2$—$Si(Me)_3$, and trimethylsilyl.

In any embodiment, Formula I, II, or III, each X is independently selected from methyl, benzyl, trimethylsilyl, neopentyl, ethyl, propyl, butyl, phenyl, hydrido, chloro, fluoro, bromo, iodo, dimethylamido, diethylamido, dipropylamido, and diisopropylamido; $R^1$ is 2,6-diisopropylphenyl, 2,4,6-triisopropylphenyl, 2,6-diisopropyl-4-methylphenyl, 2,6-diethylphenyl, 2-ethyl-6-isopropylphenyl, 2,6-bis(3-pentyl)phenyl, 2,6-dicyclopentylphenyl, or 2,6-dicyclohexylphenyl; $R^1$ is 2,6-diisopropylphenyl and $R^{13}$ is a hydrocarbyl group containing 1, 2, 3, 4, 5, 6, or 7 carbon atoms; $R^{13}$ is phenyl, 2-methylphenyl, 2-ethylphenyl, 2-propylphenyl, 2,6-dimethylphenyl, 2-isopropylphenyl, 4-methylphenyl, 3,5-dimethylphenyl, 3,5-di-tert-butylphenyl, 4-fluorophenyl, 3-methylphenyl, 4-dimethylaminophenyl, or 2-phenylphenyl.

In any embodiment, Formula II, J is dihydro-1H-indenyl and $R^1$ is 2,6-dialkylphenyl or 2,4,6-trialkylphenyl.

Metallocene Catalysts

As used herein, the "metallocene compound" can include "half sandwich" and "full sandwich" compounds having one or more "Cp" ligands (cyclopentadienyl and ligands isolobal to cyclopentadienyl) bound to at least one Group 3 to Group 12 metal atom, and one or more leaving group(s) bound to at least one metal atom. Hereinafter, these compounds will be referred to as "metallocenes" or "metallocene catalyst components".

In any embodiment, the one or more metallocene catalyst components are represented by the formula (IV):

$$Cp^ACp^BMX_n,$$

The metal atom "M" of the metallocene catalyst compounds may be selected from the group consisting of Groups 3 through 10 atoms, more preferably Groups 4, 5 and 6 atoms, and most preferably is a Ti, Zr, or Hf atom. The Cp ligand(s) can form at least one chemical bond with the metal atom M to form the "metallocene catalyst compound." The Cp ligands are distinct from the leaving groups bound to the catalyst compound in that they are not highly susceptible to substitution/abstraction reactions.

In any embodiment, each X is chemically bonded to M, each Cp group is chemically bonded to M, and n is 0, 1, 2, 3, 4.

The ligands represented by $Cp^A$ and $Cp^B$ in formula (IV) may be the same or different cyclopentadienyl ligands or ligands isolobal to cyclopentadienyl, either or both of which may contain heteroatoms and either or both of which may be substituted by a group R. In any embodiment, $Cp^A$ and $Cp^B$ are independently selected from the group consisting of cyclopentadienyl, indenyl, tetrahydroindenyl, fluorenyl, and substituted derivatives of each.

Independently, each $Cp^A$ and $Cp^B$ of formula (IV) may be unsubstituted or substituted with any one or combination of substituent groups R. Non-limiting examples of substituent groups R as used in structure (IV) include hydrogen radicals, hydrocarbyls, lower hydrocarbyls, substituted hydrocarbyls, heterohydrocarbyls, alkyls, lower alkyls, substituted alkyls, heteroalkyls, alkenyls, lower alkenyls, substituted alkenyls, heteroalkenyls, alkynyls, lower alkynyls, substituted alkynyls, heteroalkynyls, alkoxys, lower alkoxys, aryloxys, hydroxyls, alkylthios, lower alkyls thios, arylthios, thioxys, aryls, substituted aryls, heteroaryls, aralkyls, aralkylenes, alkaryls, alkarylenes, halides, haloalkyls, haloalkenyls, haloalkynyls, heteroalkyls, heterocycles, heteroaryls, heteroatom-containing groups, silyls, boryls, phosphinos, phosphines, aminos, amines, cycloalkyls, acyls, aroyls, alkylthiols, dialkylamines, alkylamidos, alkoxycarbonyls, aryloxycarbonyls, carbomoyls, alkyl- and dialkyl-carbamoyls, acyloxys, acylaminos, aroylaminos, and combinations thereof.

Each X in formula (IV) is independently selected from the group consisting of halogen ions, hydrides, hydrocarbyls, lower hydrocarbyls, substituted hydrocarbyls, heterohydrocarbyls, alkyls, lower alkyls, and substituted alkyls. In any embodiment, X is $C_1$ to $C_{12}$ alkyls, $C_2$ to $C_{12}$ alkenyls, $C_6$ to $C_{12}$ aryls, $C_7$ to $C_{20}$ alkylaryls, $C_1$ to $C_{12}$ alkoxys, $C_6$ to $C_{16}$ aryloxys, $C_7$ to $C_{18}$ alkylaryloxys, $C_1$ to $C_{12}$ fluoroalkyls, $C_6$ to $C_{12}$ fluoroaryls, and $C_1$ to $C_{12}$ heteroatom-containing hydrocarbons and substituted derivatives thereof.

In any embodiment, the metallocene catalyst component includes those of formula (IV) where $Cp^A$ and $Cp^B$ are bridged to each other by at least one bridging group (A), such that the structure is represented by formula (V): $Cp^A(A)Cp^BMX_n$. These bridged compounds represented by formula (V) are known as "bridged metallocenes". $Cp^A$, $Cp^B$, M, X and n are as defined above for formula (IV); and wherein each Cp ligand is chemically bonded to M, and (A) is chemically bonded to each Cp. Non-limiting examples of bridging group (A) include divalent alkyls, divalent lower alkyls, divalent substituted alkyls, divalent heteroalkyls, divalent alkenyls, divalent lower alkenyls, divalent substituted alkenyls, divalent heteroalkenyls, divalent alkynyls, divalent lower alkynyls, divalent substituted alkynyls, divalent heteroalkynyls, divalent alkoxys, divalent lower alkoxys, divalent aryloxys, divalent alkylthios, divalent lower alkyl thios, divalent arylthios, divalent aryls, divalent substituted aryls, divalent heteroaryls, divalent aralkyls, divalent aralkylenes, divalent alkaryls, divalent alkarylenes, divalent haloalkyls, divalent haloalkenyls, divalent haloalkynyls, divalent heteroalkyls, divalent heterocycles, divalent heteroaryls, divalent heteroatom-containing groups, divalent hydrocarbyls, divalent lower hydrocarbyls, divalent substituted hydrocarbyls, divalent heterohydrocarbyls, divalent silyls, divalent boryls, divalent phosphinos, divalent phosphines, divalent aminos, divalent amines, divalent ethers, divalent thioethers. More particular non-limiting examples of bridging group (A) are represented by $C_1$ to $C_6$ alkylenes, substituted $C_1$ to $C_6$ alkylenes, oxygen, sulfur, $R'_2C{=}$, $R'_2Si{=}$, $-Si(R')_2Si(R'_2)-$, $R'_2Ge{=}$, $R'P{=}$ (wherein "=" represents two chemical bonds), where R' is independently selected from the group consisting of hydride, hydrocarbyl, substituted hydrocarbyl, halocarbyl, substituted halocarbyl, hydrocarbyl-substituted organometalloid, halocarbyl-substituted organometalloid, disubstituted boron, disubstituted Group 15 atoms, substituted Group 16 atoms, and halogen radical; and wherein two or more R' may be joined to form a ring or ring system. In any embodiment the bridged metallocene catalyst component of formula (V) has two or more bridging groups (A).

Some non-limiting examples of bridging group (A) include methylene, ethylene, ethylidene, propylidene, isopropylidene, diphenylmethylene, 1,2-dimethylethylene, 1,2-diphenylethylene, 1,1,2,2-tetramethylethylene, dimethylsilyl, diethylsilyl, methyl-ethylsilyl, trifluoromethylbutylsilyl, bis(trifluoromethyl)silyl, di(n-butyl)silyl, di(n-propyl)silyl, di(i-propyl)silyl, di(n-hexyl)silyl, dicyclohexylsilyl, diphenylsilyl, cyclohexylphenylsilyl, t-butylcyclohexylsilyl, di(t-butylphenyl)silyl, di(p-tolyl)silyl and the corresponding moieties wherein the Si atom is replaced by a Ge or a C atom; dimethylsilyl, diethylsilyl, dimethylgermyl and diethylgermyl.

In any embodiment, the ligands $Cp^A$ and $Cp^B$ of formula (IV) and (V) can be different from each other or the same.

In any embodiment, the metallocene catalyst components include mono-ligand metallocene compounds (e.g., mono cyclopentadienyl catalyst components) such as described in WO 93/08221, for example. The at least one metallocene catalyst component can be a bridged "half-sandwich" metallocene represented by the formula (VI): $CP^A(A)QMX_n$, wherein $Cp^A$ is defined above and is bound to M; (A) is defined above and is a bridging group bonded to Q and $Cp^A$; and wherein an atom from the Q group is bonded to M; and n is 0 or an integer from 1 to 3. In formula (VI), $Cp^A$, (A) and Q may form a fused ring system. The X groups and n of formula (VI) are as defined above in formula (IV) and (V). In any embodiment $Cp^A$ is selected from the group consisting of cyclopentadienyl, indenyl, tetrahydroindenyl, fluorenyl, substituted versions thereof, and combinations thereof.

In formula (VI), Q is a heteroatom-containing ligand in which the bonding atom (the atom that is bonded with the metal M) is selected from the group consisting of Group 15 atoms and Group 16 atoms, and selected from the group consisting of nitrogen, phosphorus, oxygen or sulfur atom. Non-limiting examples of Q groups include ethers, amines, phosphines, thioethers, alkylamines, arylamines, mercapto compounds, ethoxy compounds, carboxylates (e.g., pivalate), carbamates, azenyl, azulene, pentalene, phosphoyl, phosphinimine, pyrrolyl, pyrozolyl, carbazolyl, borabenzene, and other compounds comprising of Group 15 and Group 16 atoms capable of bonding with M.

In any embodiment, at least one metallocene catalyst component is an unbridged "half sandwich" metallocene represented by the formula (VII): $Cp^AMQ_qX_n$, wherein $Cp^A$ is defined as for the Cp groups in (IV) and is a ligand that is bonded to M; each Q is independently bonded to M; Q can be bound to $Cp^A$; X is a leaving group as described above in (IV); n ranges from 0 to 3, or more particularly, 1 or 2; q ranges from 0 to 3, and is 1 or 2 in any embodiment. In any embodiment, $Cp^A$ is selected from the group consisting of cyclopentadienyl, indenyl, tetrahydroindenyl, fluorenyl, substituted version thereof, and combinations thereof.

In formula (VII), Q is selected from the group consisting of $ROO^-$, RO—, R(O)—, —NR—, $—CR_2—$, —S—, $—NR_2$, $—CR_3$, —SR, $—SiR_3$, $—PR_2$, —H, and substituted and unsubstituted aryl groups, wherein R is selected from the group consisting of hydrocarbyls, lower hydrocarbyls, substituted hydrocarbyls, heterohydrocarbyls, alkyls, lower alkyls, substituted alkyls, heteroalkyls, alkenyls, lower alkenyls, and substituted alkenyls. In any embodiment R is also selected from $C_1$ to $C_6$ alkyls, $C_6$ to $C_{12}$ aryls, $C_1$ to $C_6$ alkylamines, $C_6$ to $C_{12}$ alkylarylamines, $C_1$ to $C_6$ alkoxys, $C_6$ to $C_{12}$ aryloxys, and the like. Non-limiting examples of Q include $C_1$ to $C_{12}$ carbamates, $C_1$ to $C_{12}$ carboxylates (e.g., pivalate), $C_2$ to $C_{20}$ alkyls, and $C_2$ to $C_{20}$ heteroallyl moieties.

It is contemplated that the metallocene catalyst components described above include their structural or optical or enantiomeric isomers (racemic mixture), and can be a pure enantiomer. As used herein, a single, bridged, asymmetrically substituted metallocene catalyst component having a racemic and/or meso isomer does not, itself, constitute at least two different bridged, metallocene catalyst components.

Support Material

Catalyst systems often comprise a support material. The support material is a porous support material, for example, talc, and inorganic oxides. Other support materials include zeolites, clays, organoclays, or any other organic or inorganic support material, or mixtures thereof. As used herein, "support" and "support material" are used interchangeably.

The support material is an inorganic oxide in a finely divided form. Suitable inorganic oxide materials for use in the supported catalyst systems herein include Groups 2, 4, 13, and 14 metal oxides such as silica, alumina, and mixtures thereof. Other inorganic oxides that may be employed, either alone or in combination, with the silica or alumina are magnesia, titania, zirconia, and the like. Other suitable support materials, however, can be employed, for example, finely divided functionalized polyolefins such as finely divided polyethylene. Particularly useful supports include magnesia, titania, zirconia, montmorillonite, phyllosilicate, zeolites, talc, clays, and the like. Also, combinations of these support materials may be used, for example, silica-chromium, silica-alumina, silica-titania, and the like. Exemplary support materials include $Al_2O_3$, $ZrO_2$, $SiO_2$, and combinations thereof.

In any embodiment, the support material, such as an inorganic oxide, has a surface area in the range of from about 10 $m^2/g$ to about 700 $m^2/g$, pore volume in the range of from about 0.1 $cm^3/g$ to about 4.0 $cm^3/g$, and average particle size in the range of from about 5 μm to about 500 μm. The surface area of the support material is in the range of from about 50 $m^2/g$ to about 500 $m^2/g$, pore volume of from about 0.5 $cm^3/g$ to about 3.5 $cm^3/g$, and average particle size of from about 10 μm to about 200 μm. In any embodiment, the surface area of the support material is in the range of from about 100 $m^2/g$ to about 400 $m^2/g$, pore volume from about 0.8 $cm^3/g$ to about 3.0 $cm^3/g$, and average particle size is from about 5 μm to about 100 μm. The average pore size of the support material useful in producing the bimodal PAO blends described herein can be in the range of from 10 to 1,000 Å, 50 to about 500 Å, and 75 to about 350 Å. In any embodiment, the support material is a high surface area, amorphous silica (surface area ≥300 $m^2/gm$, pore volume ≥1.65 $cm^3/gm$), and is marketed as Davison™ 952 or Davison™ 955 by the Davison Chemical Division of W. R. Grace and Company, are particularly useful. In any embodiment, Davidson™ 948 is used.

The support material may be dry, that is, free of absorbed water. Drying of the support material can be achieved by heating or calcining at about 100° C. to about 1000° C., at least about 600° C. When the support material is silica, it is typically heated to at least 200° C., about 200° C. to about 850° C., and at about 600° C.; and for a time of about 1 minute to about 100 hours, from about 12 hours to about 72 hours, or from about 24 hours to about 60 hours. The calcined support material has at least some reactive hydroxyl (OH) groups.

In any embodiment the support material is fluorided. Fluoriding agent containing compounds may be any compound containing a fluorine atom. Particularly desirable are inorganic fluorine containing compounds are selected from the group consisting of $NH_4BF_4$, $(NH_4)_2SiF_6$, $NH_4PF_6$, $NH_4F$, $(NH_4)_2TaF_7$, $NH_4NbF_4$, $(NH_4)_2GeF_6$, $(NH_4)_2SmF_6$, $(NH_4)_2TiF_6$, $(NH_4)_2ZrF_6$, $MoF_6$, $ReF_6$, $GaF_3$, $SO_2ClF$, $F_2$, $SiF_4$, $SF_6$, $ClF_3$, $ClF_5$, $BrF_5$, $IF_7$, $NF_3$, HF, $BF_3$, $NHF_2$ and $NH_4HF_2$. Of these, ammonium hexafluorosilicate and ammonium tetrafluoroborate are useful. Combinations of these compounds may also be used.

Ammonium hexafluorosilicate and ammonium tetrafluoroborate fluorine compounds are typically solid particulates as are the silicon dioxide supports. A desirable method of treating the support with the fluorine compound is to dry mix the two components by simply blending at a concentration of from 0.01 to 10.0 millimole F/g of support, desirably in the range of from 0.05 to 6.0 millimole F/g of support, and most desirably in the range of from 0.1 to 3.0 millimole F/g of support. The fluorine compound can be dry mixed with the support either before or after charging to a vessel for dehydration or calcining the support. Accordingly, the fluorine concentration present on the support is in the range of from 0.1 to 25 wt %, alternately 0.19 to 19 wt %, alternately from 0.6 to 3.5 wt %, based upon the weight of the support.

The above two metal catalyst components can be deposited on the support material at a loading level of 10-100 micromoles of metal per gram of solid support; alternately 20-80 micromoles of metal per gram of solid support; or 40-60 micromoles of metal per gram of support. But greater or lesser values may be used provided that the total amount of solid complex does not exceed the support's pore volume.

Activators

The supported catalyst systems can be formed by combining the above two metal catalyst components with activators in any manner known from the literature including by supporting them for use in slurry or gas phase polymerization. Activators are defined to be any compound which can activate any one of the catalyst compounds described above by converting the neutral metal compound to a catalytically active metal compound cation. Non-limiting activators, for example, include alumoxanes, aluminum alkyls, ionizing activators, which may be neutral or ionic, and conventional-type cocatalysts. Useful activators include alumoxane compounds, modified alumoxane compounds, and ionizing anion precursor compounds that abstract a reactive, σ-bound, metal ligand making the metal compound cationic and providing a charge-balancing noncoordinating or weakly coordinating anion. Suitable activators for use in the processes described herein include any one or more of the activators described in PCT/US2016/021757.

After the complexes have been synthesized, catalyst systems may be formed by combining the complexes with activators in any manner known from the literature including by supporting them for use in slurry or gas phase polymerization. The catalyst systems may also be added to or generated in solution polymerization or bulk polymerization (in the monomer). The catalyst system typically comprises a complex as described above and an activator such as alumoxane or a non-coordinating anion. Activation may be performed using alumoxane solution including methyl alumoxane, referred to as MAO, as well as modified MAO, referred to herein as MMAO, containing some higher alkyl groups to improve the solubility. Particularly useful MAO can be purchased from Albemarle in a 10 wt % solution in toluene. The catalyst system employed in the producing the present blends can use an activator selected from alumoxanes, such as methyl alumoxane, modified methyl alumoxane, ethyl alumoxane, iso-butyl alumoxane, and the like. Mixtures of different alumoxanes and modified alumoxanes may also be used. A visually clear methylalumoxane can be useful. A cloudy or gelled alumoxane can be filtered to produce a clear solution, or a clear alumoxane can be decanted from the cloudy solution. A useful alumoxane is a modified methyl alumoxane (MMAO) cocatalyst type 3A (commercially available from Akzo Chemicals, Inc. under the trade name Modified Methylalumoxane type 3A, covered under U.S. Pat. No. 5,041,584).

When an alumoxane or modified alumoxane is used, the catalyst complex-to-activator molar ratio is from about 1:3000 to 10:1; alternatively, 1:2000 to 10:1; alternatively 1:1000 to 10:1; alternatively, 1:500 to 1:1; alternatively 1:300 to 1:1; alternatively 1:200 to 1:1; alternatively 1:100 to 1:1; alternatively 1:50 to 1:1; alternatively 1:10 to 1:1. When the activator is an alumoxane (modified or unmodified), the maximum amount of activator can be at a 5000-fold molar excess over the catalyst precursor (per metal catalytic site). In any embodiment, the minimum activator-to-complex ratio is 1:1 molar ratio.

Activation may also be performed using non-coordinating anions, referred to as NCA's. NCA may be added in the form of an ion pair using, for example, [DMAH]+[NCA]− in which the N,N-dimethylanilinium ("DMAH") cation reacts with a basic leaving group on the transition metal complex to form a transition metal complex cation and [NCA]−. The cation in the precursor may, alternatively, be trityl. Alternatively, the transition metal complex may be reacted with a neutral NCA precursor, such as $B(C_6F_5)_3$, which abstracts an anionic group from the complex to form an activated species. Useful activators include N,N-dimethylanilinium tetrakis (pentafluorophenyl)borate (i.e., $[PhNMe_2H]B(C_6F_5)_4$) and N,N-dimethylanilinium tetrakis (heptafluoronaphthyl) borate, where Ph is phenyl, and Me is methyl.

Non-coordinating anion ("NCA)" is defined to mean an anion either that does not coordinate to the catalyst metal cation or that does coordinate to the metal cation, but only weakly. The term NCA is also defined to include multi-component NCA-containing activators, such as N,N-dimethylanilinium tetrakis(pentafluorophenyl)borate, that contain an acidic cationic group and the non-coordinating anion. The term NCA is also defined to include neutral Lewis acids, such as tris(pentafluorophenyl)boron, that can react with a catalyst to form an activated species by abstraction of an anionic group. An NCA coordinates weakly enough that a neutral Lewis base, such as an olefinically or acetylenically unsaturated monomer can displace it from the catalyst center. Any metal or metalloid that can form a compatible, weakly coordinating complex may be used or contained in the noncoordinating anion. Suitable metals include, but are not limited to, aluminum, gold, and platinum. Suitable metalloids include, but are not limited to, boron, aluminum, phosphorus, and silicon. The term non-coordinating anion includes ionic activators and Lewis acid activators.

The NCA containing activator is one or more of N,N-dimethylanilinium tetra(perfluorophenyl)borate, N,N-dimethylanilinium tetrakis(perfluoronaphthyl)borate, N,N-dimethylanilinium tetrakis(perfluorobiphenyl)borate, N,N-dimethylanilinium tetrakis(3,5-bis(trifluoromethyl)phenyl) borate, triphenylcarbenium tetrakis(perfluoronaphthyl) borate, triphenylcarbenium tetrakis(perfluorobiphenyl) borate, triphenylcarbenium tetrakis(3,5-bis(trifluoromethyl) phenyl)borate, triphenylcarbenium tetrakis (perfluorophenyl)borate, methyl bis(hydrogenated tallow) ammonium tetrakis(perfluorophenyl)borate, or methyl dialkylammonium tetrakis(perfluoroaryl)borate.

Activators include N,N-dimethylanilinium tetrakis(perfluoronaphthyl)borate, N,N-dimethylanilinium tetrakis(perfluorobiphenyl)borate, N,N-dimethylanilinium tetrakis(perfluorophenyl)borate, N,N-dimethylanilinium tetrakis(3,5-bis(trifluoromethyl)phenyl)borate, triphenylcarbenium tetrakis(perfluoronaphthyl)borate, triphenylcarbenium tetrakis(perfluorobiphenyl)borate, triphenylcarbenium tetrakis(3,5-bis(trifluoromethyl)phenyl)borate, triphenylcarbenium tetrakis(perfluorophenyl)borate, [Ph3C+][B(C6F5)4-], [Me3NH+][B(C6F5)4-]; 1-(4-(tris(pentafluorophenyl)borate)-2,3,5,6-tetrafluorophenyl)pyrrolidinium; and tetrakis (pentafluorophenyl)borate, 4-(tris(pentafluorophenyl)borate)-2,3,5,6-tetrafluoropyridine.

The activator can comprise a triaryl carbonium (such as triphenylcarbenium tetraphenylborate, triphenylcarbenium tetrakis(pentafluorophenyl)borate, triphenylcarbenium tetrakis-(2,3,4,6-tetrafluorophenyl)borate, triphenylcarbenium tetrakis(perfluoronaphthyl)borate, triphenylcarbenium tetrakis(perfluorobiphenyl)borate, triphenylcarbenium tetrakis(3,5-bis(trifluoromethyl)phenyl)borate).

Furthermore, the activator can comprise one or more of trialkylammonium tetrakis(pentafluorophenyl)borate, N,N-dialkylanilinium tetrakis(pentafluorophenyl)borate, N,N-dimethyl-(2,4,6-trimethylanilinium) tetrakis(pentafluorophenyl)borate, trialkylammonium tetrakis-(2,3,4,6-tetrafluorophenyl) borate, N,N-dialkylanilinium tetrakis-(2,3,4,6-tetrafluorophenyl)borate, trialkylammonium tetrakis (perfluoronaphthyl)borate, N,N-dialkylanilinium tetrakis (perfluoronaphthyl)borate, trialkylammonium tetrakis (perfluorobiphenyl)borate, N,N-dialkylanilinium tetrakis (perfluorobiphenyl)borate, trialkylammonium tetrakis(3,5-bis(trifluoromethyl)phenyl)borate, N,N-dialkylanilinium tetrakis(3,5-bis(trifluoromethyl)phenyl)borate, N,N-dialkyl-(2,4,6-trimethylanilinium) tetrakis(3,5-bis(trifluoromethyl) phenyl)borate, di-(i-propyl)ammonium tetrakis(pentafluorophenyl)borate, (where alkyl is methyl, ethyl, propyl, n-butyl, sec-butyl, or t-butyl).

When an NCA (such as an ionic or neutral stoichiometric activator) is used, the catalyst complex-to-activator molar ratio is typically from 1:10 to 1:1; 1:10 to 10:1; 1:10 to 2:1; 1:10 to 3:1; 1:10 to 5:1; 1:2 to 1.2:1; 1:2 to 10:1; 1:2 to 2:1; 1:2 to 3:1; 1:2 to 5:1; 1:3 to 1.2:1; 1:3 to 10:1; 1:3 to 2:1; 1:3 to 3:1; 1:3 to 5:1; 1:5 to 1:1; 1:5 to 10:1; 1:5 to 2:1; 1:5 to 3:1; 1:5 to 5:1; 1:1 to 1:1.2.

Polymerization

The catalyst complexes described herein are useful in polymerizing monomers which undergo coordination catalyst-catalyzed polymerization such as solution, slurry, gas-phase, and high-pressure polymerization. Typically, one or more of the catalyst complexes described herein, one or more activators, and one or more monomers are contacted to produce polymer product. In any embodiment the complexes are supported and, as such, are useful in fixed-bed, moving-bed, fluid-bed, slurry, solution, or bulk operating modes conducted in single, series, or parallel reactors.

One or more reactors in series or in parallel may be used to produce the blends described herein. The complexes, activator and when required co-activator, may be delivered as a solution or slurry, either separately to the reactor, activated in-line just prior to the reactor, or pre-activated and pumped as an activated solution or slurry to the reactor. Polymerizations are carried out in either single reactor operation, in which monomer, comonomers, catalyst/activator/co-activator, optional scavenger, and optional modifiers are added continuously to a single reactor, or in series reactor operation where components are added to each of two or more reactors connected in series. The catalyst components can be added to the first reactor in the series. The catalyst component may also be added to both reactors, with one component being added to first reaction and another component to other reactors. In any embodiment, the complex is activated in the reactor in the presence of olefin.

Polymerization/Oligomerization processes used herein can comprise contacting one or more alkene monomers with the complexes (and, optionally, activator) described herein. The process can be homogeneous (solution or bulk polymerization) or heterogeneous (slurry—in a liquid diluent, or gas phase—in a gaseous diluent). In the case of heterogeneous slurry or gas phase polymerization, the complex and activator may be supported. Silica is useful as a support herein. Hydrogen may be used to produce the blends described herein.

The reactor temperatures can range from −10° C. to 250° C., from 30° C. to 220° C., from 50° C. to 180° C., and from 60° C. to 170° C. The reactor pressure can be from 0.1 to 100 atmospheres, from 0.5 to 75 atmospheres, and from 1 to 50 atmospheres. Alternatively, the pressure of the reactor can be from 1 to 50,000 atmospheres, and 1 to 25,000 atmospheres. The monomer(s), complex and activator can be contacted for a residence times of: 1 second to 100 hours; 30 seconds to 50 hours; 2 minutes to 6 hours; and 1 minute to 4 hours. Solvent or diluent can be present in the reactor. Solvent and diluents are selected from the group including butanes, pentanes, hexanes, heptanes, octanes, nonanes, decanes, undecanes, dodecanes, tridecanes, tetradecanes, pentadecanes, hexadecanes, toluene, o-xylene, m-xylene, p-xylene, mixed xylenes, ethylbenzene, isopropylbenzene, and n-butylbenzene; toluene and or xylenes and or ethylbenzene, normal paraffins (such as Norpar™ solvents available from ExxonMobil Chemical Company), or isoparaffin solvents (such as Isopar™ solvents available from ExxonMobil Chemical Company). The solvents or diluents are usually pre-treated in the same manner as olefin feed.

Typically, in the polymerization, one or more complexes, one or more activators, and one or more monomers are contacted to produce polymer or oligomer. Catalysts can be supported and as such will be particularly useful in the known slurry, solution, or bulk operating modes conducted in single, series, or parallel reactors. If the catalyst, activator or co-activator is a soluble compound, the reaction can be carried out in a solution mode. Even if one of the components is not completely soluble in the reaction medium or in the feed solution, either at the beginning of the reaction or during or at the later stages of the reaction, a solution or slurry type operation is still applicable. Catalyst system components, dissolved or suspended insolvents, such as toluene or other conveniently available aromatic solvents, or in aliphatic solvent, or in the feed alpha-olefin stream, are typically fed into the reactor under inert atmosphere (usually nitrogen or argon blanketed atmosphere) to allow the polymerization or oligomerization to take place.

The polymerization or oligomerization can be operated in a batch mode, where all the components are added into a reactor and allowed to react to a pre-designed degree of conversion, either to partial conversion or full conversion. Subsequently, the catalyst is deactivated by any possible means, such as exposure to air or water, or by addition of alcohols or solvents containing deactivating agents. The polymerization or oligomerization can also be operated in a semi-continuous operation, where feeds and catalyst system components are continuously and simultaneously added to the reactor so as to maintain a constant ratio of catalyst system components to feed olefin(s). When all feeds and components of the catalyst system are added, the reaction is allowed to proceed to a pre-determined stage. The reaction is then discontinued by catalyst deactivation in the same manner as described for batch operation.

The polymerization or oligomerization can also be operated in a continuous operation, where feeds and catalyst system components are continuously and simultaneously added to the reactor so to maintain a constant ratio of catalyst system and feed olefins. The reaction product is continuously withdrawn from the reactor, as in a typical continuous stirred tank reactor (CSTR) operation. The residence times of the reactants are controlled by a pre-determined degree of conversion. The withdrawn product is then typically quenched in the separate reactor in a similar manner as other operation. Typically, processes for making the PAO described herein are continuous processes.

Continuous processes comprise the steps of: (a) continuously introducing a feed stream having at least 10 mol % of one or more C5 to C24 alpha-olefins into a reactor; (b) continuously introducing the complex and the activator into the reactor; and (c) continuously withdrawing the polyalpha-olefin from the reactor. In addition, continuous processes include the step of: maintaining a partial pressure of hydrogen in the reactor based upon the total pressure of the reactor at 200 psi (1379 kPa) or less, 150 psi (1034 kPa) or less, 100 psi (690 kPa) or less, 50 psi (345 kPa) or less, 25 psi (173 kPa) or less, and 10 psi (69 kPa) or less. Hydrogen can be present in the reactor at 1000 ppm or less by weight, 750 ppm or less, 500 ppm or less, 250 ppm or less, 100 ppm or less, 50 ppm or less, 25 ppm or less, 10 ppm or less, and 5 ppm or less. Hydrogen can be present in the feed at 1000 ppm or less by weight, 750 ppm or less, 500 ppm or less, 250 ppm or less, 100 ppm or less, 50 ppm or less, 25 ppm or less, 10 ppm or less, and 5 ppm or less.

Reactors can range in size from 2 ml and up. Reactors larger than one liter in volume can be used for commercial production. The production facility can have one single reactor or several reactors arranged in series or in parallel or in both to maximize productivity, product properties, and general process efficiency. The reactors and associated equipment are usually pre-treated to ensure proper reaction rates and catalyst performance. The reaction is usually conducted under inert atmosphere, where the catalyst system and feed components will not be in contact with any catalyst deactivator or poison which is usually polar oxygen, nitrogen, sulfur, or acetylenic compounds.

One or more reactors in series or in parallel can be used. The complex, activator and when required, co-activator, may be delivered as a solution or slurry in a solvent or in the alpha-olefin feed stream, either separately to the reactor, activated in-line just prior to the reactor, or pre-activated and pumped as an activated solution or slurry to the reactor. Polymerizations/oligomerization are carried out in either single reactor operation, in which monomer, or several monomers, catalyst/activator/co-activator, optional scavenger, and optional modifiers are added continuously to a single reactor or in series reactor operation, in which the above components are added to each of two or more reactors connected in series. The catalyst system components can be added to the first reactor in the series. Alternatively, components of the catalyst system component can be added to both reactors, with one component being added to first reaction and another component to other reactors.

The complex is typically activated in the reactor in the presence of olefin. Alternatively, the complex such as a dichloride form of the metallocene compounds can be pre-treated with alkylaluminum reagents, especially, tri-isobutylaluminum, tri-n-hexylaluminum, and/or tri-n-octyl-aluminum, and followed by charging into the reactor containing other catalyst system component and the feed olefins, or followed by pre-activation with the other catalyst system component to give the fully activated catalyst, that is then fed into the reactor containing feed olefins. Alternatively, the pre-catalyst metallocene is mixed with the activator and/or the co-activator and activated catalyst is then charged into reactor, together with feed olefin stream containing some scavenger or co-activator. The co-activator (in whole or part) can be pre-mixed with the feed olefins and charged into the reactor at the same time as the other catalyst solution containing metallocene and activators and/or co-activator.

Complexes (catalyst compositions) can be used individually or can be mixed with other known polymerization catalysts to prepare polymer or oligomer blends. Monomer and catalyst selection allows for polymer or oligomer blend preparation under conditions analogous to those using individual catalysts. Polymers having increased MWD are available from polymers made with mixed catalyst systems and can thus be achieved. Mixed catalyst systems include two or more complexes, and or two or more activators.

Monomers

Monomers useful in producing the bimodal PAO blends described herein include olefins having from 2 to 30 carbon atoms, alternately 7 to 22 carbon atoms (such as hexene, heptene, octene, nonene, decene, dodecene, tetradecene, hexadecene, octadecene, eicosene, and docosene) and optionally polyenes (such as dienes). Monomers include decene, and mixtures of $C_8$ to $C_{12}$ alpha olefins and tetradecene, hexadecene, octadecene, and the like.

The complexes described herein are also particularly effective for the polymerization of higher alpha olefins, specifically with olefins having carbon numbers greater than 7, either alone or in combination with at least one other olefinically unsaturated monomer, such as a C7 to C22 α-olefin.

In any embodiment, the monomer mixture can have one or more dienes at up to 10 wt %, such as from 0.00001 to 1.0 wt %, for example, from 0.002 to 0.5 wt %, such as from 0.003 to 0.2 wt %, based upon the monomer mixture. Non-limiting examples of useful dienes include, cyclopentadiene, norbornadiene, dicyclopentadiene, 5-ethylidene-2-norbornene, 5-vinyl-2-norbornene, 1,4-hexadiene, 1,5-hexadiene, 1,5-heptadiene, 1,6-heptadiene, 6-methyl-1,6-heptadiene, 1,7-octadiene, 7-methyl-1,7-octadiene, 1,9-decadiene, 1,9-dimethyl-1,9-decadiene.

Bimodal PAO Blends—Product

The present bimodal blend (a multimodal polyolefin composition) is a multimodal polyolefin composition comprising a first PAO composition and a second PAO composition. The first PAO composition and the second PAO composition are different by molecular weight and composition (alpha olefin carbon number), such that the GPC trace has more than one peak or inflection point.

The first PAO composition (sometimes referred to as the low molecular weight ("low MW") component and a second PAO composition (sometimes referred herein as the high molecular ("high MW") component. The molecular weight of the bimodal blend can be affected by reactor conditions including, but not limited to, the temperature and pressure of the reactor, and the monomer and catalyst concentrations as well as the presence of chain-terminating or chain-transfer agents, and the like.

The term "multimodal," when used to describe these polymer or oligomer compositions, means "multimodal molecular weight distribution," which is understood to mean that the Gel Permeation Chromatography ("GPC") trace, plotted as Absorbance versus Retention Time (seconds), has more than one peak or at least one inflection point, preferably has at least two inflection points. An "inflection point" is a point where the second derivative of the curve changes in sign (e.g., from negative to positive or vice versa).

For example, a polyolefin composition that includes a first component, a low molecular weight polymer component (such as a polymer having a Mn less than 10,000 g/mol) and a second high molecular weight polymer component (such as a polymer having a Mn of 10,000 g/mol or more, preferably greater than 10,000 g/mol) is considered to be a "bimodal" polyolefin composition.

The low molecular weight ("MW") component of the present bimodal blends is between about 60 to about 99 wt % ("wt %") and from 70 to 97 wt %. The low MW component comprises oligomers of alpha olefin carbon number from 7 to 12 ($C_7$ to $C_{12}$), or heptene to dodecene. The low MW component has a Mn of about 100 to less than 10,000, and about 200 to about 8,000 and a polydispersity index or Mw/Mn of about 1.2 to about 6, about 1.4 to about 5, and about 1.5 to about 4.

The high MW component of the present bimodal blends is between about 1 to about 40 wt %, or more specifically, about 2 to about 35 wt % and from about 3 to about 30 wt %. The high MW component of the present bimodal blends are polymers of alpha olefin carbon number from 13 to 30 (C13 to C30), and more specifically from 13 to 22 (C13 to C22), or tridecene to docosene. The high MW component has a Mn from 10,000 g/mole to 750,000 g/mole, and more specifically, from about 12,500 g/mole to about 600,000 g/mole, and from about 15,000 g/mole to about 450,000 g/mole and a Mw/Mn from about 1.2 to about 6, and more specifically from about 1.4 to about 5, and from about 1.5 to about 4.

The PAO produced is a tactic polymer, could be isotactic or syndiotactic, or an atactic polymer. Isotactic polymers may have at least 20% (alternatively at least 30%, alternatively at least 40%) isotactic pentads. A polyolefin is "atactic" also referred to as "amorphous" if it has less than 10% isotactic pentads and syndiotactic pentads. Microstructure is determined by $^{13}$C-NMR spectroscopy, including the concentration of isotactic and syndiotactic diads ([m] and [r]), triads ([mm] and [rr]), and pentads ([mmmm] and [rrrr]). The designation "m" or "r" describes the stereochemistry of pairs of contiguous propylene groups, "m" referring to meso and "r" to racemic. Samples are dissolved in $d_2$-1,1,2,2-tetrachloroethane, and spectra recorded at 125° C. using a 100 MHz (or higher) NMR spectrometer. Polymer resonance peaks are referenced to mmmm=21.8 ppm. Calculations involved in the characterization of polymers by NMR are described by F. A. Bovey in Polymer Conformation and Configuration (Academic Press, New York 1969) and J. Randall in Polymer Sequence Determination, $^{13}$C-NMR METHOD (Academic Press, New York, 1977).

The bimodal PAO blends thus made are useful as grease lubricants for automobile and industrial lubrication applications.

This invention further relates to:

1. A bimodal blend comprising:
   - a first PAO composition having a number average molecular weight of less than 10,000 g/mol and a carbon number from 7 to 12; and
   - a second PAO composition having a number average molecular weight of 10,000 g/mol or more and carbon number greater than 12,
   - wherein both the first and second PAO compositions are produced by coordinative insertion polymerization and the concentration of the first PAO composition in the blend is between about 60 wt % and 99 wt % of the total weight of the bimodal blend.
2. The bimodal blend of paragraph 1, wherein the concentration of the second PAO composition is between about 1 wt % and 40 wt % of the total weight of the bimodal blend.
3. The bimodal blend of paragraph 1, wherein the first PAO composition comprises oligomers (e.g. having an Mn of less than 10,000 g/mol).
4. The bimodal blend of any one of the preceding paragraphs, wherein the second PAO composition comprises polymers (e.g., having an Mn of 10,000 g/mol or more).
5. The bimodal blend of any one of the preceding paragraphs, wherein the first PAO composition is produced with Group IV metallocone catalysts.
6. The bimodal blend of any one of the preceding paragraphs, wherein the second PAO composition is produced with a pyridyldiamido transition metal complex.
7. The bimodal blend of any one of the preceding paragraphs, wherein the second PAO composition is produced with a quinolyldiamido transition metal complex.
8. The bimodal blend of any one of the preceding paragraphs comprising poly(alpha olefin)s of poly(1-heptene) and above.

9. The bimodal blend of any one of the preceding paragraphs comprising alpha olefins with a carbon number greater than 6.
10. The bimodal blend of any one of the preceding paragraphs comprising bottlebrushes, wherein the square root of the bottlebrush side chain length is greater than the distance between side chains.
10.5 The bimodal blend of any one of the preceding paragraphs comprising bottlebrushes, where the side chain length is greater than the distance between side chains along the backbone.
11. The bimodal blend of any one of the preceding paragraphs comprising bottlebrushes having a fully extended backbone and bottlebrush conformations.
12. The bimodal blend of any one of the preceding paragraphs, wherein the bimodal blend is a solid lubricant having a yield stress less than 100 Pa.
13. The bimodal blend of any one of the preceding paragraphs, wherein the bimodal blend is a liquid lubricant having a yield stress of greater than 100 Pa and a viscosity less than 100 Pa/s.
14. A lubricant comprising:
a base oil; and
a thickener, the thickener comprising a PAO composition having a number average molecular weight of 10,000 g/mol or more and carbon number greater than 12, wherein both the base oil and the PAO compositions are produced by coordinative insertion polymerization and the concentration of the base oil in the lubricant is between about 60 wt % and 99 wt % of the total weight of the bimodal blend.
15. The lubricant of paragraph 14, wherein the base oil is selected from the group of mineral oil and synthetic fluid.
16. The lubricant of paragraph 15, wherein the synthetic fluid is an oligomer of octene, decene or dodecene.
17. The lubricant of paragraph 15, wherein the base oil is a PAO composition having a number average molecular weight of less than 10,000 g/mol.
18. The lubricant of any one of the preceding paragraphs, wherein the base oil is an oligomer having a carbon number from 7 to 12.
19. The lubricant of any one of the preceding paragraphs, wherein the lubricant is a solid grease.
20. The lubricant of any one of the preceding paragraphs, wherein the lubricant does not contain dispersion aids.
21. The lubricant of any one of the preceding paragraphs, wherein the lubricant comprises percolation network of second PAO crystals.
22. A method of making lubricants comprising the step of blending a first PAO composition and a second PAO composition, wherein the first PAO composition has a number average molecular weight of less than 10,000 g/mol and a carbon number from 7 to 12; and the second PAO composition has a number average molecular weight of 10,000 g/mol or more and carbon number greater than 12, both the first and second PAO compositions are produced by coordinative insertion polymerization, and the concentration of the first PAO composition in the lubricant is between about 60 wt % and 99 wt % of the total weight of the grease lubricant.

EXAMPLES

It is to be understood that while the invention has been described in conjunction with the specific embodiments thereof, the foregoing description is intended to illustrate and not limit the scope of the invention. In any embodiment, advantages and modifications will be apparent to those skilled in the art to which the invention pertains.

Therefore, the following examples are put forth to provide those skilled in the art with a complete disclosure and description which are not intended to limit the scope of that which the inventors regard as their invention.

Example I

Oligomeric Decene Base Oil

An oligomeric decene base oil was synthesized. Specifically, isotactic poly(decene) having a number average MW of 6,000 (and a weight average MW of 10,800) was synthesized in a solution reactor, with isohexane as the solvent, by coordinative insertion polymerization with a C2-symmetric metallocene of rac-dimethylsilylene bis(tetrahydroindenyl) zirconium dimethyl (shown in FIG. 1) activated with N,N-dimethylanilinium tetrakis(pentafluorophenyl) borate. A feed of mixed decene monomer was used with a majority, >70%, decene balanced by octene and dodecene. The oligomeric decene was hydrogenated to remove all un-saturations present at or near the chain ends. It is a liquid with a viscosity of 300 cSt measured at 100° C. with an Mn of 6,000 g/mole and Mw of 10,800 g/mole, and an isotacticity (iso triad content) of 92%. An oligomer was provided having an average monomer number of 46 and less than 100 carbons on the backbone.

Example II

Poly(1-octene)

Figure 2:
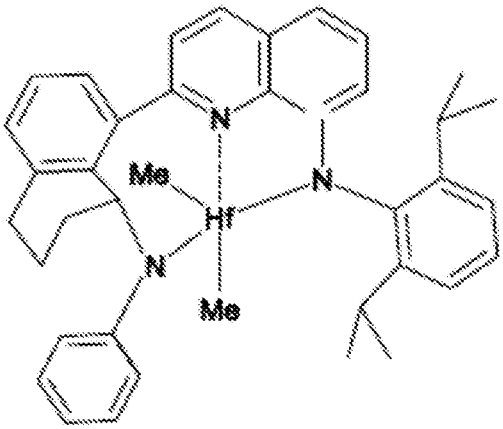
FIG. 2 depicts the catalyst used to synthesize the high molecular weight PAOs poly(1-octene), poly(1-tetradecene), and poly(1-octadecene) in Examples 2, 3 and 4, respectively.

This example (Example 2) describes the synthesis of poly(1-octene). 1-Octene (40 mL) and hexane (200 mL) were combined in a 500 mL round-bottomed flask. A 1.0 mM toluene solution of N,N-dimethylanilinium tetrakis (pentafluorophenyl) borate (3.0 mL, 0.0030 mmol) was added at 23° C. followed by a 1 mM toluene of a quinolinyldiamide ("QDA") catalyst of N-(2,6-diisopropylphenyl)-2-(8-(phenylamido)-5,6,7,8-tetrahydronaphthalen-1-yl) quinolin-8-amido dimethyl hafnium (3 mL, 0.0030 mmol). The catalyst structure is shown in FIG. 2. The mixture was stirred rapidly, and, within 5 minutes, the mixture had thickened. After 1 hour the mixture was viscous, but still stirring. A toluene solution (2 mL) of Irganox 1076 (20 mg) was added to quench the polymerization. The volatiles were evaporated at 60° C. under a stream of nitrogen. The product was isolated as a sticky pale yellow "amorphous" solid. As measured by GPC, this poly(1-octene) has a Mn of 1,175,000 g/mole, a Mw of 3,320,000 g/mole, and a Mw/Mn of 2.82.

Example III

High Molecular Weight Poly(1-tetradecene)

This example (Example 3) describes the synthesis of a high molecular weight poly(1-tetradecene). 1-tetradecene and hexane were combined in a 250 mL round-bottomed flask. A 1.0 mM toluene solution of N,N-dimethylanilinium tetrakis(pentafluorophenyl) borate (3.0 mL, 0.0030 mmol) was added at ambient temperature followed by a 1 mM toluene of N-(2,6-diisopropylphenyl)-2-(8-(phenylamido)-5,6,7,8-tetrahydronaphthalen-1-yl) quinolin-8-amido dimethyl hafnium (3 mL, 0.0030 mmol). The catalyst structure is shown in FIG. 2. The mixture was stirred rapidly and allowed to react for 1 hour at 23° C. A toluene solution (2 mL) of Irganox 1076 (20 mg) was added to quench the polymerization. The polymer was recovered by evaporation at 60° C. under nitrogen. As measured by GPC, this poly (1-tetradecene) crystalline solid has a Mn of 2,138,000 g/mole, a Mw of 4,820,000 g/mole, and a Mw/Mn of 2.08.

Example IV

High Molecular Weight Poly(1-Octadecene)

This example (Example 4) describes the synthesis of high molecular weight poly(1-octadecene). 1-octadecene and hexane were combined in a 250 mL round-bottomed flask. A 1.0 mM toluene solution of N,N-dimethylanilinium tetrakis(pentafluorophenyl) borate (3.0 mL, 0.0030 mmol) was added at ambient temperature followed by a 1 mM toluene of N-(2,6-diisopropylphenyl)-2-(8-(phenylamido)-5,6,7,8-tetrahydronaphthalen-1-yl) quinolin-8-amido dimethyl hafnium (3 mL, 0.0030 mmol). The catalyst structure is shown in FIG. 2. The mixture was stirred rapidly and allowed to react for 1 hour at 23° C. A toluene solution (2 mL) of Irganox 1076 (20 mg) was added to quench the polymerization. The polymer was recovered by evaporation at 60° C. under nitrogen. As measured by GPC, this poly(1-octadecene) crystalline solid has a Mn of 313,000, a Mw of 817,000, and a Mw/Mn of 2.61.

Example V

Atactic Poly(1-Octadecene)

Figure 3:
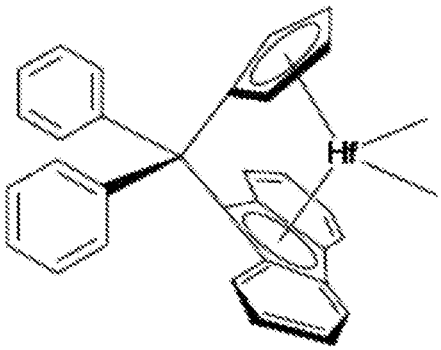
FIG. 3 depicts the catalyst used to synthesize the PAO atactic poly(1-octadecene) in Examples 5, 6, and 7.

This example (Example 5) describes the synthesis of atactic poly(1-octadecene). Toluene (70 mL) was combined with 1-octadecene (58.7 g). The mixture was heated to 100° C. in an oil bath and a hexane solution of bis(di-isobutylaluminum)oxide ("DIBALO") (1.8 mL, 1.66 mmol of Al) was added. A toluene solution (15 mL) of a Cs symmetric metallocene of (diphenylmethylene)-bis((1,2,3,3a,7a-η)-1H-inden-1-ylidene)) dimethyl hafnium (40 mg, 0.066 mmol) and N,N-dimethylanilinium tetrakis(pentafluorophenyl) borate (53 mg, 0.066 mmol) was added gradually in several portions over 35 minutes. The catalyst structure is shown in FIG. 3. The maximum temperature reached during the catalyst addition was 117° C. The mixture was stirred for a total of 2 hours, then the volatiles were removed with a stream of nitrogen, followed by bubbling through the hot mixture. The thick solution was poured into a tray and dried in a vacuum oven overnight. Cooling to ambient temperature afforded a yellow tinted waxy (crystalline) solid. As measured by GPC, this poly(1-octadecene) crystalline solid has a Mn of 17,000 g/mole, a Mw of 54,000 g/mole, and a Mw/Mn of 3.17.

Example VI

Atactic Poly(1-octadecene)

This example (Example 6) describes the synthesis of atactic poly(1-octadecene). Toluene (20 mL) and 1-octadecene (89.6 g) were combined and heated to 93° C. in an oil bath. A hexane solution of DIBALO (2.75 mL, 2.53 mmol Al) was then added. A toluene solution (15 mL) of (diphenylmethylene)-bis((1,2,3,3a,7a-η)-1H-inden-1-ylidene)) dimethyl hafnium (31.0 mg, 0.0514 mmol) and N,N-dimethylanilinium tetrakis(pentafluorophenyl) borate (41.2 mg, 0.0514 mmol) was added gradually in several portions over 1 hour. The catalyst structure is shown in FIG. 3. The maximum temperature reached during the catalyst addition was 115° C. The mixture became viscous. After an additional hour, a significant portion of the volatiles were removed by bubbling nitrogen through the hot mixture. The resulting hot solution was poured into a tray and dried overnight in a vacuum oven to afford a yellow waxy solid. As measured by GPC, this poly(1-octadecene) crystalline solid has a Mn of 52,000 g/mole, a Mw of 113,000 g/mole, and a Mw/Mn of 2.17.

Example VII

Atactic Poly(1-octadecene)

This example (Example 7) describes the synthesis of atactic poly(1-octadecene). Toluene (90 mL) and 1-octadecene (73.9 g) were combined and heated to 71° C. in an oil bath. A hexane solution of DIBALO (2.25 mL, 2.07 mmol Al) was then added. A toluene solution (15 L) of (diphenylmethylene)-bis((1,2,3,3a,7a-η)-1H-inden-1-ylidene)) dimethyl hafnium (25 mg, 0.042 mmol) and N,N-dimethylanilinium tetrakis(pentafluorophenyl) borate (34 mg, 0.042 mmol) was added gradually in several portions over 1 hour. The catalyst structure is shown in FIG. 3. The maximum temperature reached during the catalyst addition was 74° C. The mixture became viscous. After an additional hour a significant portion of the volatiles were removed by bubbling nitrogen through the hot mixture. The resulting hot solution was poured into a tray and dried overnight in a vacuum oven to afford a yellow waxy solid. As measured by GPC, this poly(1-octadecene) crystalline solid has a Mn of 150,000 g/mole, a Mw of 352,000 g/mole, and a Mw/Mn of 2.36.

Example VIII

Isotactic Poly(1-octadecene)

Figure 4:
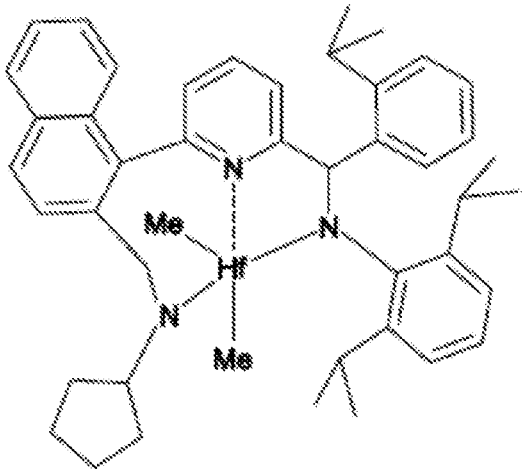
FIG. 4 depicts the catalyst used to synthesize the moderate molecular weight PAO isotactic poly(1-octadecene) in Examples 8 and 9.

This example (Example 8) describes the synthesis of isotactic poly(1-octadecene). First, 1-Octadecene (8.00 g) was loaded into a vial. At 23° C., a 1.0 mM toluene solution of N,N-dimethylanilinium tetrakis(pentafluorophenyl) borate (0.5 mL) activator was added followed by a 1.0 mM toluene solution of a pyridyldiamide (PDA) catalyst of (N-(2,6-bis(1-methylethyl)phenyl)-6-(2-((cyclopentylamino-κN)methyl)-1-naphthalenyl)-α-(2-(1-methylethyl) phenyl)-2-pyridinemethanaminato(2-)-κN1,κN2) dimethyl hafnium catalyst (0.5 mL). The catalyst structure is shown in FIG. 4. The mixture was swirled and allowed to sit. After 30 min the mixture was viscous and cloudy. An additional 0.5 mL of each activator and catalyst solution were added at this time and the mixture was stirred manually. After a total of 3.25 hours, the mixture was removed from the dry box and the waxy (crystalline) material was stirred in boiling acetone. The resulting white waxy solid was isolated and dried. As measured by GPC-IR, this poly(1-octadecene) crystalline solid has a Mn of 69,000 g/mole, a Mw of 195,000 g/mole, and a Mw/Mn of 2.82. Based on C13 NMR determination, this poly(1-octadecene) has an isotactic triad (mm) content of 82%.

Example IX

Isotactic Poly(1-octadecene)

This example (Example 9) describes the synthesis of isotactic poly(1-octadecene). 1-Octadecene (17.4 g) and hexane (35 mL) were combined in a 250 mL round-bottomed flask. A 1.0 mM toluene solution of N,N-dimethylanilinium tetrakis(pentafluorophenyl) borate (1.0 mL) activator was added at 23° C. followed by a 1.0 mM toluene solution of (N-(2,6-bis(1-methylethyl)phenyl)-6-(2-((cyclopentylamino-κN)methyl)-1-naphthalenyl)-α-(2-(1-methylethyl)phenyl)-2-pyridinemethanaminato(2-)-κN1,κN2) dimethyl hafnium catalyst (1.0 mL). The catalyst structure is shown in FIG. 4. The mixture was stirred rapidly and began to thicken within a minute. After one hour, the mixture was cloudy and thick. Additional activator and catalyst solutions (1.0 mL of each) were added. After stirring for a total of 2 hours, the mixture was poured into acetone and stirred. The resulting white waxy solid was isolated and dried. As measured by GPC-IR, this poly(1-octadecene) crystalline solid has a Mn of 86,000 g/mole, a Mw of 215,000 g/mole, and a Mw/Mn of 2.49. Based on a $^{13}$C-NMR determination, this poly(1-octadecene) has an isotactic triad (mm) content of 91%.

Example X

Linear High Density Polyethylene

Figure 5:
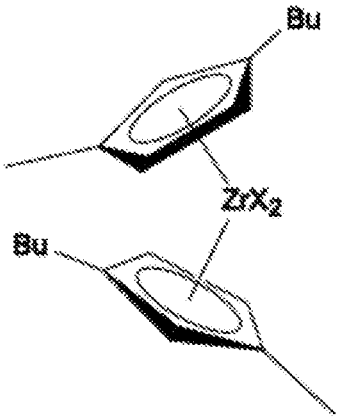
FIG. 5 depicts the catalyst used to synthesize the polyethylene control in Example 10.

This example (Example 10) describes the synthesis of linear high density polyethylene. A high density polyethylene was synthesized in a laboratory gas phase reactor using a supported (on silica) metallocene catalyst activated by MAO (methylaluminoxane). The catalyst structure can be seen in FIG. 5. Based on the GPC, this polyethylene is linear with Mn of 10,000 g/mole, Mw of 78,000 g/mole, and Mw/Mn of 7.81. Its backbone MW length is equivalent to that of the bottlebrush poly(1-octadecene) synthesized in Example 9. This polyethylene was synthesized for comparative measurement purposes.

Example XI

Figure 6A:
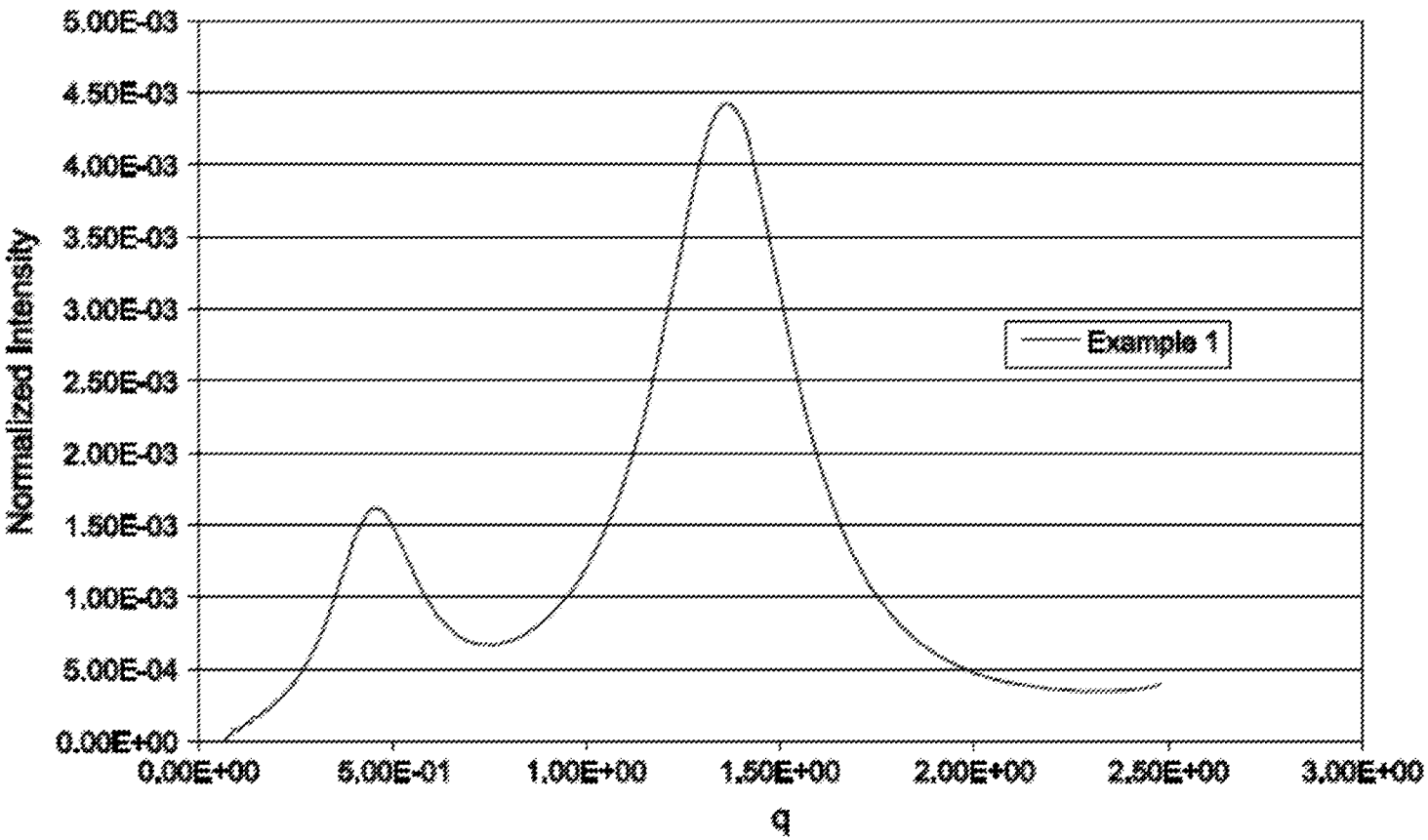
FIG. 6A is a graph showing the x-ray scattering pattern of the oligomer synthesized in Example 1 at 23° C.
Figure 6B:
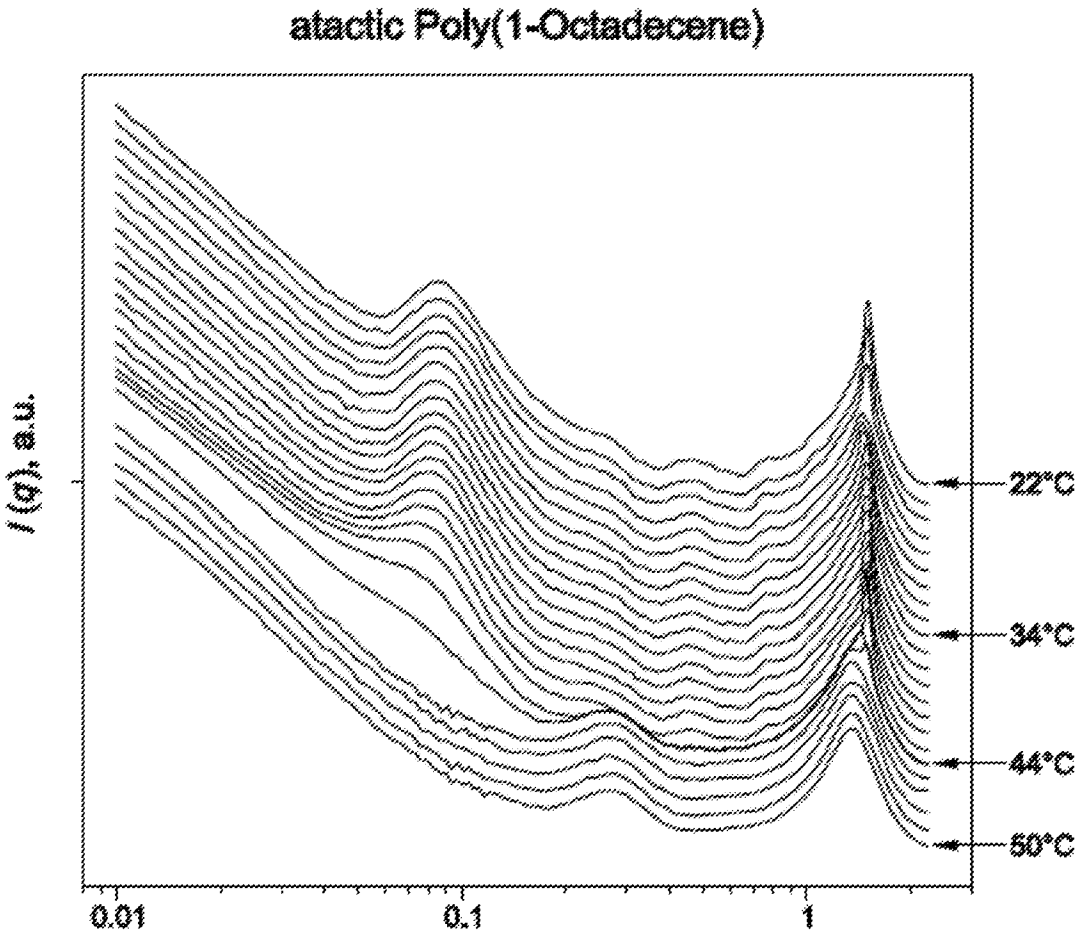
FIG. 6B is a graph showing the x-ray scattering patterns of the PAO synthesized in Example 7 at various temperatures.
Figure 6C:
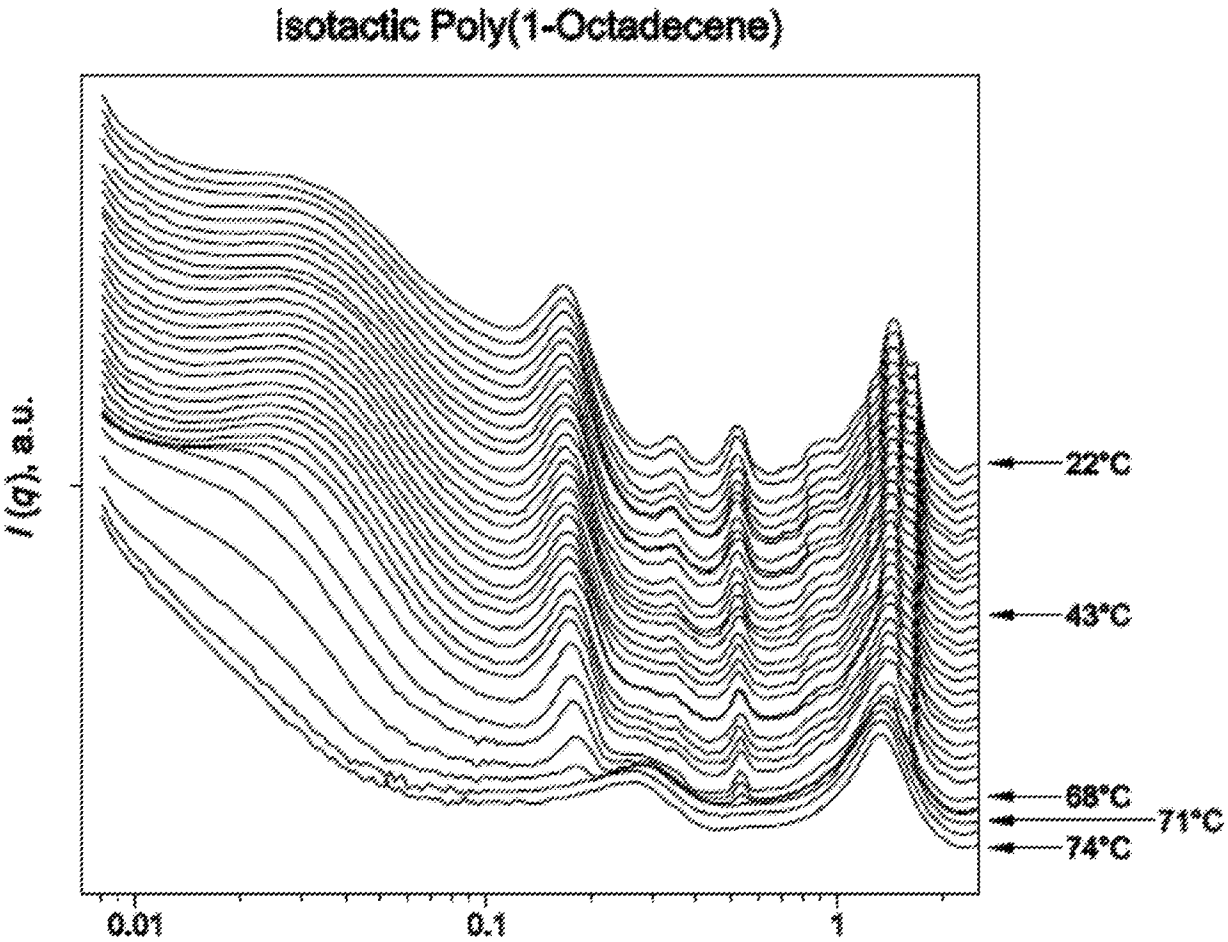
FIG. 6C is a graph showing the x-ray scattering patterns of the PAO synthesized in Example 9 at various temperatures.

Both x-ray scattering and neutron scattering were employed to confirm and measure the bottlebrush structures of the poly(alpha olefin) liquids and solids synthesized. Neutron scattering for the polyoctadecene solid was measured from blends of deuterated polyoctadecene and polyoctadecene after the deuterium and hydrogen exchange reaction was performed on polyoctadecene. Neutron scattering for the oligomeric decene liquid was determined from deuterated squalane solutions containing dissolved oligomeric decene. The x-ray scattering patterns of the compounds synthesized in Example 1, Example 7, and Example 9 are found in FIGS. 6A, 6B, and 6C, respectively. FIG. 6A is the x-ray scattering pattern of oligomer synthesized in Example 1, oligomeric decene, at 23° C. FIG. 6B is the x-ray scattering pattern of the PAO synthesized in Example 7, atactic poly(1-octadecene), at various temperatures. FIG. 6C is the x-ray scattering pattern of the PAO synthesized in Example 9, poly(1-octadecene), at various temperatures. The small q is a measure of the rod diameter. The rod length is measured by neutron scattering through fitting the scattering data with a flexible rod model. A simulation result of 10-mer decene (conformation determined by energy minimization) demonstrates that these bottlebrush oligomers and polymers adopt a 4/1 helical structure and form flexible rods with the rod diameter determined by the square root of the side chain and the rod length controlled by the backbone length.

Table 1 provides the rod diameters and lengths of the bottlebrush oligomers and PAOs synthesized.

TABLE 1

Rod Diameter and Length of Bottlebrush Oligomers and Polymers

| Example | Monomer | Rod Diameter (nm) | Rod Length (nm) | Composition Appearance |
|---|---|---|---|---|
| 1 | Decene | 1.4 | 9 | Liquid |
| 2 | Octene | 1.2 | 2,500 | Amorphous solid |
| 3 | Tetradecene | 1.8 | 3,000 | Waxy solid |
| 4 | Octadecene | 2.4 | 300 | Waxy solid |
| 5 | Octadecene | 2.4 | 15 | Waxy solid |
| 6 | Octadecene | 2.4 | 50 | Waxy solid |
| 7 | Octadecene | 2.4 | 140 | Waxy solid |
| 8 | Octadecene | 2.4 | 60 | Waxy solid |
| 9 | Octadecene | 2.4 | 80 | Waxy solid |

Example XII

The linear high density polyethylene synthesized in Example 10 was produced to have the equivalent backbone length, about 80 nm, as that of the PAO synthesized in Example 9, the bottlebrush polyoctadecene. The compounds synthesized in Examples 9 and 10 were separately dissolved in ortho-dichlorobenzene ("o-DCB") solvent at 150° C. Pieces of silicon wafer were dipped into each solution to allow the deposition of the compounds synthesized in Examples 9 and 10 onto the silicon wafer. These dip-coated silicon wafers were transferred to Atomic Force Microscopy ("AFM") for contact force and contact friction measurements using a colloidal probe at the tip of the AFM cantilever. Three different colloidal probes of different tip radii were used to exert various contact pressures. The wafers were mounted on a temperature stage so that the contact force and contact friction values could be measured above the melting temperatures of polyethylene ("PE") and polyoctadecene ("POD"), to ensure that both compositions were in their liquid state. The contact force and friction measurements were conducted in accordance to 11 ACS Nano, 1762 (2017).

Figure 7:
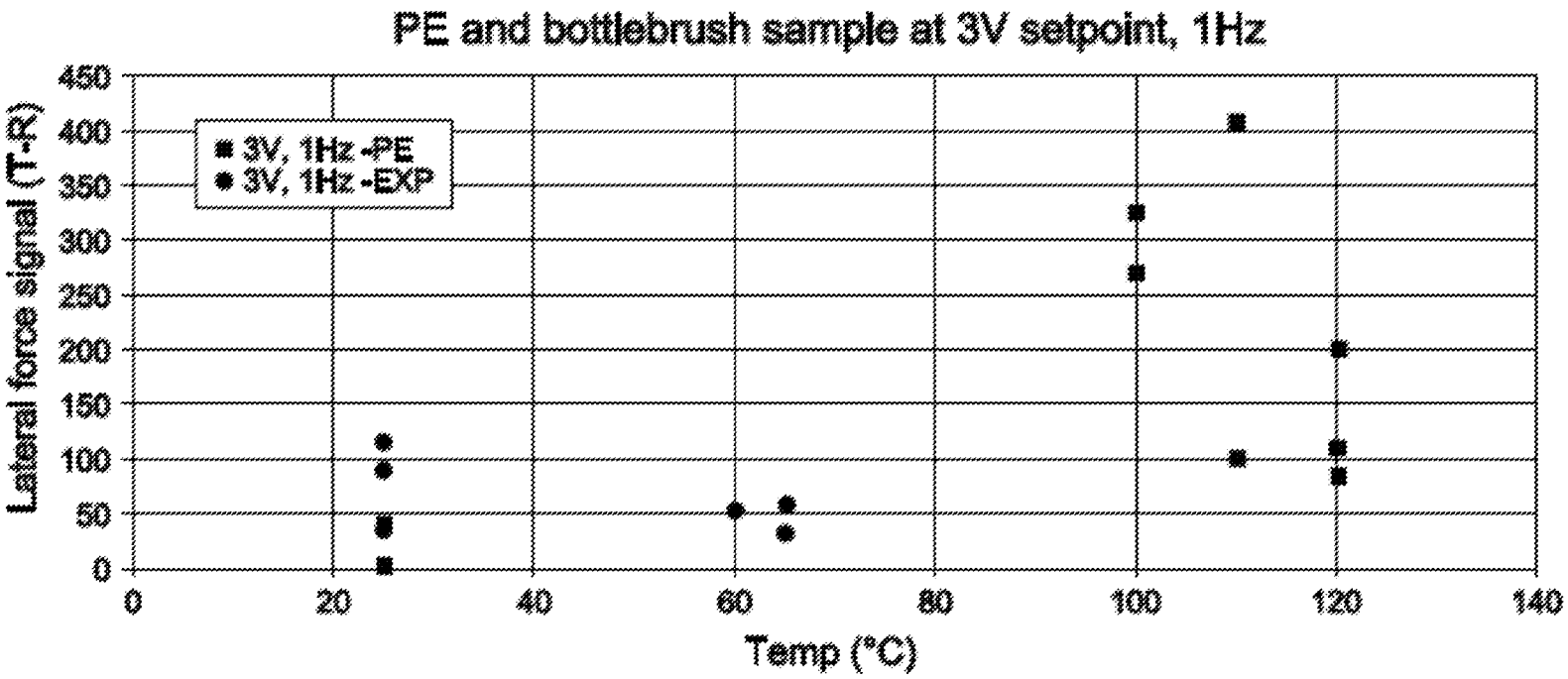
FIG. 7 is a graph showing the lateral force measures for the PAO synthesized in Example 9 and the PE synthesized in Example 10 under a normal load of 45 nN across various temperatures.

Linear molecules of PE were squeezed out under the contact tip resulting in a high frictional coefficient, whereas the bottlebrush POD was organized and aligned by hexagonal rod packing at the surface leading to a surface protective layer which has low friction (rod to rod sliding). The frictional coefficient measured on the POD surfaces is ⅙ of the value measured on the PE surfaces. Therefore, bottlebrushes can have excellent lubrication properties resulting from their rod structures allowing them to be easily packed and slide. The frictional coefficients of PE and POD at various temperatures are shown in FIG. 7 under a normal load of 45 nN. Low frictional values can be seen in POD above the melting temperature of 50° C., and high frictional values can be seen in PE above the melting temperature of 100° C.

Example XIII

Mixing First and Second PAO Compositions to Produce the Biomodal Blends

By dissolving a thickener (a high molecular weight PAO composition/second component) that has longer bottlebrush rods (such as polytetradecene or polyoctadecene) into a solvent (the low molecular weight PAO composition/the first PAO composition) that has shorter and thinner bottlebrush rods (such as oligomeric decene), a grease-like bimodal blend was made due to crystallization of higher carbon number PAOs, but flows by applying stresses to allow the bottlebrush rods of the PAOs to slide past each other.

In order to form a solid grease lubricant, the longer bottlebrush (in the second component of the bimodal blend) must be able to crystallize, and therefore, retain a concentration above the phase percolation threshold. The polyoctene PAO synthesized in Example 2 does not crystallize despite its isotacticity and high molecular weight. Blending of the oligomer synthesized in Example 1 (a first PAO composition) with the PAO synthesized in Example 2 (a second PAO composition), polyoctene with oligomeric decene, did not lead to the formation of a solid lubricant (grease lubricant). However, blending the PAO synthesized in Example 5 with the oligomer synthesized in Example 1, or blending of an atactic polyoctadecene with oligomeric decene provided a solid lubricant (bimodal PAO blend) in the form of grease. This atactic polyoctadecene, Example 5, does crystallize at temperatures below 60° C. In this bimodal blend, the amount of the PAO synthesized in Example 5 was at or greater than 5%.

Figure 8:
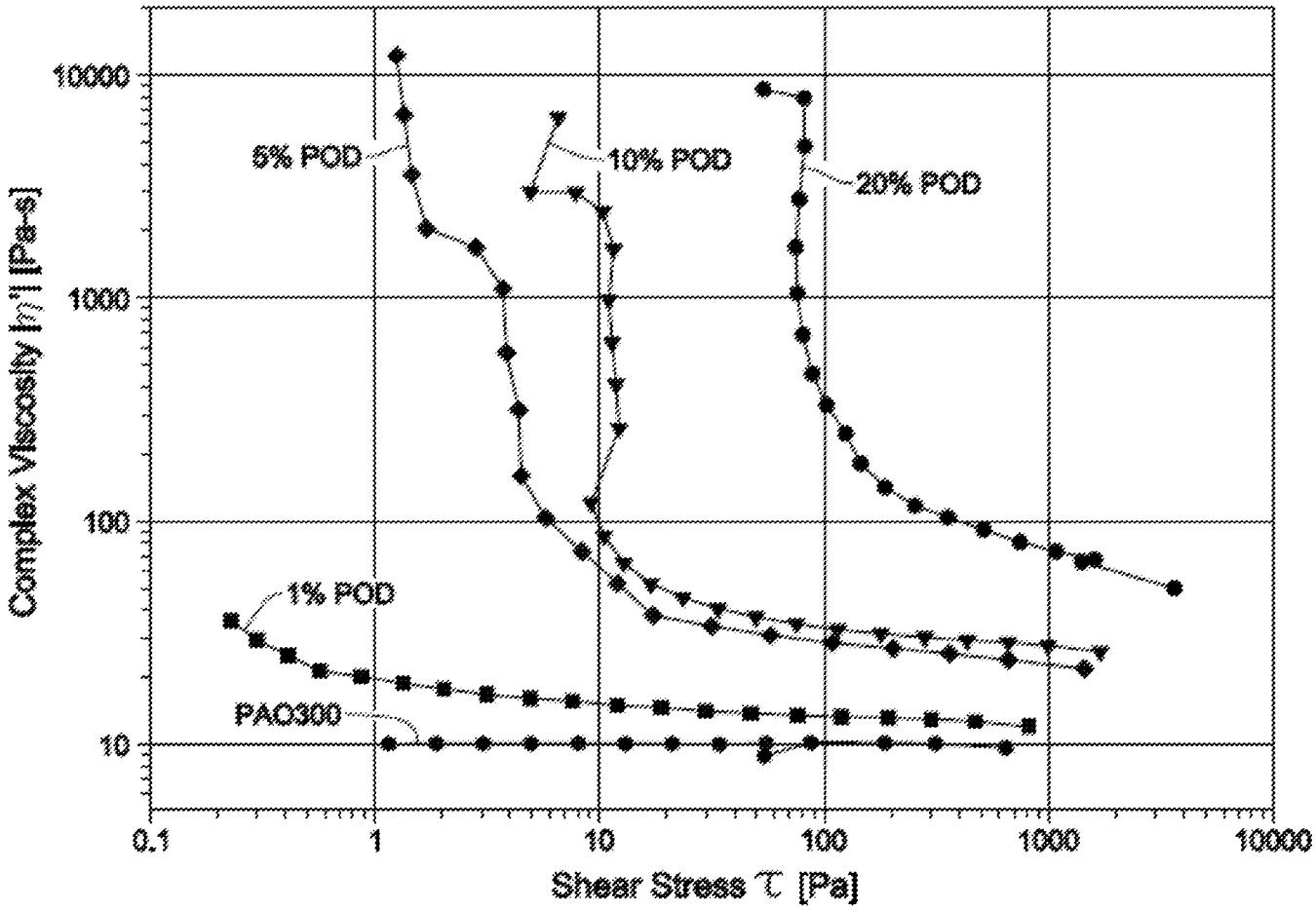
FIG. 8 is a graph showing the flow curves of the bimodal PAO blends of the oligomer synthesized in Example 1 and the PAO synthesized in Example 5 (complex viscosity from dynamic frequency sweep) as shear stress vs. complex viscosity.

As shown in FIG. 8, when the PAO synthesized in Example 5, atactic polyoctadecene was not added to the oligomer synthesized in Example 1, mPAO300, the oligomer was a Newtonian liquid. Here, the base oil, oligomeric decene, thickened with the addition of 1% of the PAO synthesized in Example 5, but the material remained a liquid. Once 5% or more of the PAO synthesized in Example 5 was added to the oligomer synthesized in Example 1 (a base oil/first PAO composition), the bimodal PAO blend became a solid, yet a Bingham plastic that flows as a liquid provided the stress exceeds the yield stress.

Figure 9:
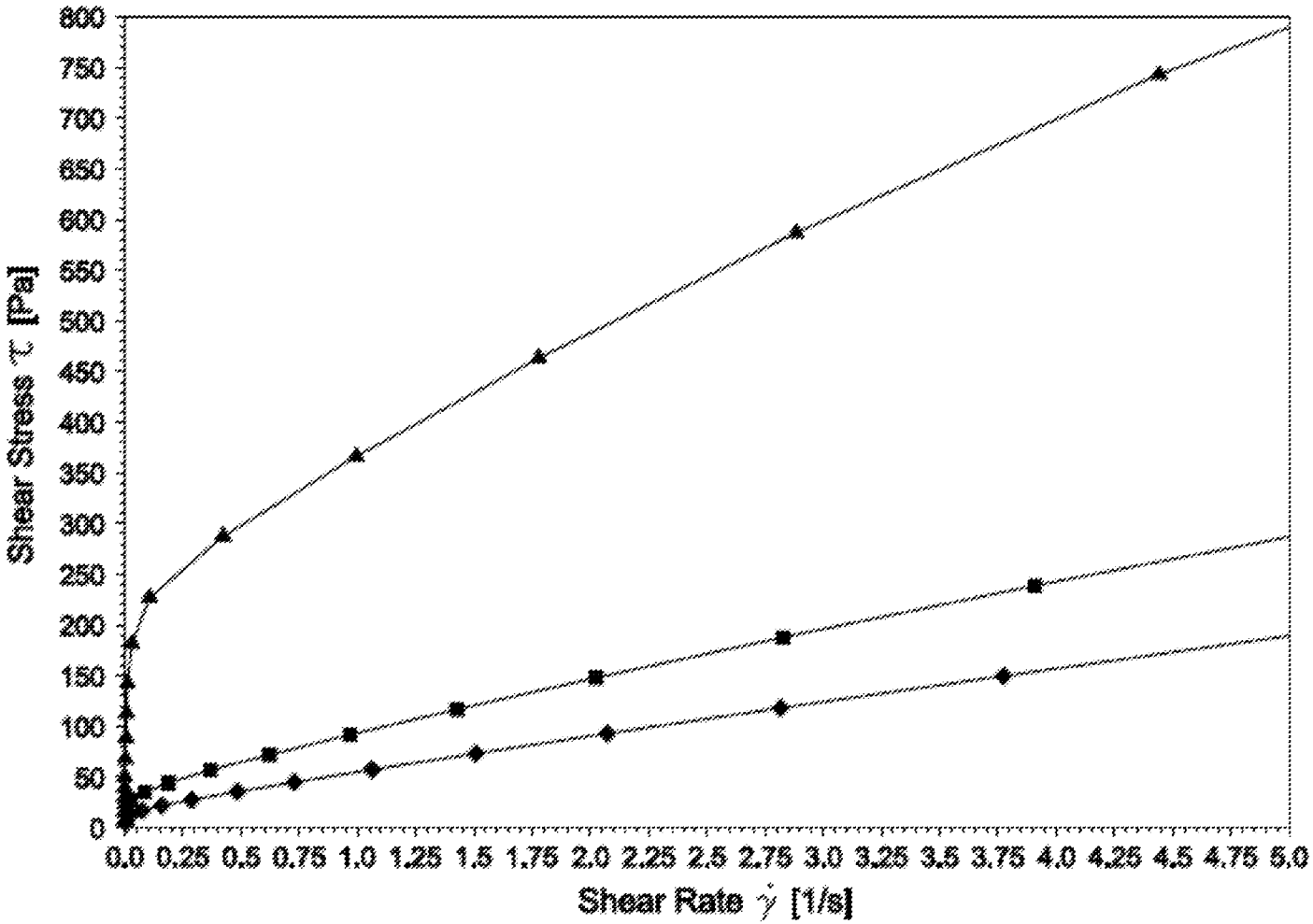
FIG. 9 is a graph showing the steady flow curves of the bimodal PAO blends of the oligomer synthesized in Example 1 and the POA synthesize in Example 5 (steady shear) as shear rate versus shear stress.
Figure 10:
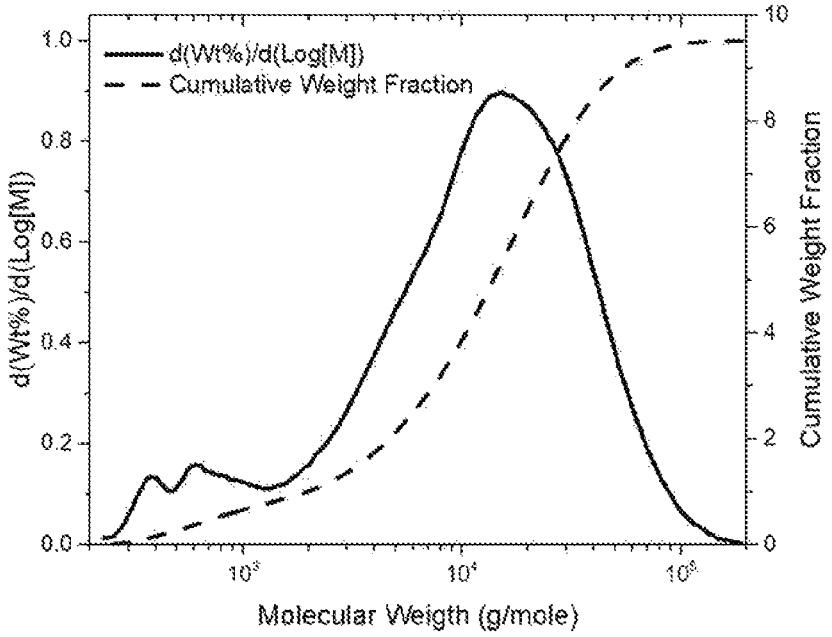
FIG. 10 is the GPC plot for the polyoctadecene in Example 5, which the used in the blend in Example 13.

The yield stress value of each of the bimodal blends is listed in Table 2 as measured from complex viscosity (FIG. 8) and steady shear viscosity (FIG. 9). FIG. 8 shows the flow curves of the complex viscosity from dynamic frequency sweep of bimodal PAO blends of the oligomer synthesized in Example 1 and the PAO synthesized in 5. FIG. 9 shows the steady flow curves of bimodal PAO blends of the oligomer synthesized in Example 1 (first PAO composition) and the PAO synthesized in Example 5 (second PAO composition). Once the grease (the bimodal PAO blend) starts flowing, viscosity values have been shown to stay low, i.e., at values below 100 Pa-s.

TABLE 2

Flow Yield Stress of Bimodal Blends of the Oligomer of Example 1 (Base Oil/First PAO Composition) and the PAO of Example 5 (Second PAO Composition)

| Blends | % of oligomer of Example 1 | % of PAO of Example 5 | Yield Stress (Pa) Complex viscosity | Yield Stress (Pa) Steady shear viscosity |
|---|---|---|---|---|
| A | 100 | 0 | None | None |
| B | 99 | 1 | None | None |
| C | 95 | 5 | 4 | 10 |
| D | 90 | 10 | 10 | 30 |
| E | 80 | 20 | 80 | 200 |

While the present bimodal blends have been described with respect to a number of embodiments and examples, those skilled in the art, having benefit of this disclosure, will appreciate that other embodiments can be devised which do not depart from the scope and spirit of the lubricants disclosed herein.

The invention claimed is:

1. A bimodal blend comprising:

a first PAO composition having a number average molecular weight of 100 to less than 10,000 g/mol and comprising oligomers of alpha-olefin having a carbon number from 7 to 12; and a second PAO composition having a number average molecular weight of 15,000 g/mol or more and comprising polymers of alpha-olefin having a carbon number greater than 12, wherein both the first and second PAO compositions are produced by coordinative insertion polymerization, and the concentration of the first PAO composition in the blend is about 60 wt % to 99 wt % of the total weight of the bimodal blend, wherein the bimodal blend is a solid lubricant at a yield stress less than 100 Pa; and wherein the first PAO composition comprises bottlebrushes, where the side chain length is greater than the distance between side chains along the backbone.

2. The bimodal blend of claim 1, wherein the concentration of the second PAO composition is about 1 wt % to 40 wt % of the total weight of the bimodal blend.

3. The bimodal blend of claim 1, wherein the first PAO composition comprises oligomers having an number average molecular weight of about 200 to about 8,000 g/mol.

4. The bimodal blend of claim 1, wherein the second PAO composition comprises polymers having an number average molecular weight of about 15,000 to 750,000 g/mol.

5. The bimodal blend of claim 1, wherein the first PAO composition is produced with Group IV metallocene compound.

6. The bimodal blend of claim 1, wherein the second PAO composition is produced with a pyridyldiamido transition metal complex.

7. The bimodal blend of claim 1, wherein the second PAO composition is produced with a quinolyldiamido transition metal complex.

8. The bimodal blend of claim 1, wherein the first PAO composition comprises poly(alpha olefin)s of poly(1-heptene) and above.

9. The bimodal blend of claim 1 comprising first and second PAO's having monomers of alpha olefins with a carbon number greater than 6.

10. A bimodal blend comprising:

a first PAO composition having a number average molecular weight of 100 to less than 10,000 g/mol and comprising oligomers of alpha-olefin having a carbon number from 7 to 12; and a second PAO composition having a number average molecular weight of 15,000 g/mol or more and comprising polymers of alpha-olefin having a carbon number greater than 12, wherein both the first and second PAO compositions are produced by coordinative insertion polymerization, and the concentration of the first PAO composition in the blend is about 60 wt % to 99 wt % of the total weight of the bimodal blend, wherein the bimodal blend is a solid lubricant at a yield stress less than 100 Pa; and wherein the second PAO composition comprises bottlebrushes, where the side chain length is greater than the distance between side chains along the backbone.

11. The bimodal blend of claim 1, wherein the bimodal blend is a solid lubricant having a yield stress less than 100 Pa.

12. The bimodal blend of claim 1, wherein the second PAO composition comprises -poly(alpha olefin)s of poly(1-heptene) and above.

13. A bimodal blend comprising:

a first PAO composition having a number average molecular weight of 100 to less than 10,000 g/mol and comprising oligomers of alpha-olefin having a carbon number from 7 to 12; and a second PAO composition having a number average molecular weight of 15,000 g/mol or more and comprising polymers of alpha-olefin having a carbon number greater than 12, wherein both the first and second PAO compositions are produced by coordinative insertion polymerization, and the concentration of the first PAO composition in the blend is about 60 wt % to 99 wt % of the total weight of the bimodal blend, wherein the bimodal blend is a solid lubricant at a yield stress less than 100 Pa, and wherein the second PAO composition comprises bottlebrushes, where the side chain length is greater than the distance between side chains along the backbone.

* * * * *